US010113791B2

(12) United States Patent
Wenji et al.

(10) Patent No.: US 10,113,791 B2
(45) Date of Patent: Oct. 30, 2018

(54) COOLING CUP HOLDER WITH ROTARY FLIP

(71) Applicant: eMoMo Technology Co., Ltd., Baoan, Shenzhen (CN)

(72) Inventors: Tang Wenji, Shenzhen (CN); Zhao Yushu, Shenzhen (CN); Song Jing, Shenzhen (CN)

(73) Assignee: eMoMo Technology Co., LTD, Shenzhen (CN)

( * ) Notice: Subject to any disclaimer, the term of this patent is extended or adjusted under 35 U.S.C. 154(b) by 529 days.

(21) Appl. No.: 14/847,980

(22) Filed: Sep. 8, 2015

(65) Prior Publication Data

US 2016/0282040 A1 Sep. 29, 2016

(30) Foreign Application Priority Data

Mar. 26, 2015 (CN) ..... 2015 1 0154312

(51) Int. Cl.

| | |
|---|---|
| ***F25B 21/02*** | (2006.01) |
| ***A47C 7/68*** | (2006.01) |
| ***A47C 7/74*** | (2006.01) |
| ***A47J 31/50*** | (2006.01) |
| ***H02J 5/00*** | (2016.01) |
| ***H01F 38/14*** | (2006.01) |
| ***H01F 27/25*** | (2006.01) |
| ***F25D 3/06*** | (2006.01) |
| ***F25D 3/08*** | (2006.01) |
| ***H02J 7/00*** | (2006.01) |

(Continued)

(52) U.S. Cl.

CPC ..... *F25D 31/006* (2013.01); *F25B 21/02* (2013.01); *A47G 23/0216* (2013.01); *F25D 2331/808* (2013.01)

(58) Field of Classification Search

CPC .. A47C 7/68; A47C 7/74; A47C 7/748; A47C 1/342; F25D 31/006; F25D 31/007; F25D 2331/803; F25D 2331/805; F25D 2400/28; F25D 3/06; F25D 3/08; B60N 3/102; B60N 3/103; B60N 3/104; B60N 2/4686; B60N 2/468; B60N 2/4606; H02J 7/025; H02J 7/0042; H02J 5/00; H02J 7/00; A47J 31/50; A47J 41/0038; H01F 38/14; H01F 27/25; B65D 2543/0025

USPC ..... 296/24.34

See application file for complete search history.

(56) References Cited

U.S. PATENT DOCUMENTS

| | | | | |
|---|---|---|---|---|
| 8,816,636 | B2 * | 8/2014 | Shinde | B60R 7/04 320/108 |
| 9,089,221 | B2 * | 7/2015 | Stangl | A47C 7/725 |
| 9,379,561 | B2 * | 6/2016 | Rejman | B25H 3/02 |

(Continued)

*Primary Examiner* — Frantz Jules
*Assistant Examiner* — Erik Mendoza-Wilkenfe
(74) *Attorney, Agent, or Firm* — Bass, Berry & Sims, PLC; Terry L. Clark

(57) ABSTRACT

The present utility model relates to a cup holder, and in particular to a cooling cup holder that is suitable for chairs including massage armchairs, sofas and seats in coaches, airplanes, ships, theaters and cinemas. The cooling cup holder includes a rotary flip so that the cooling cup holder can be covered when it is unnecessary to cool a drink, and the cooling cup holder can be open when it is necessary to cool a drink, thus keeping hygiene of the cooling cup holder. The cooling cup holder may further include a wireless charging station for wirelessly charging a mobile electronic device, for example.

20 Claims, 26 Drawing Sheets

(51) Int. Cl.
*F25D 31/00* (2006.01)
*A47G 23/02* (2006.01)

(56) References Cited

U.S. PATENT DOCUMENTS

2009/0288800 A1* 11/2009 Kang ..... B60N 2/4686
165/42
2010/0102063 A1* 4/2010 Kogami ..... B60N 3/10
220/324
2010/0201201 A1* 8/2010 Mobarhan ..... H02J 5/005
307/104
2013/0320689 A1* 12/2013 Hishon ..... B60N 3/101
296/24.34
2015/0070738 A1* 3/2015 Itoh ..... H04N 1/6077
358/523

* cited by examiner

COOLING CUP HOLDER WITH ROTARY FLIP

CROSS-REFERENCE TO RELATED APPLICATIONS

This application claims priority to Chinese Patent Application No. 201510154312.2 filed Mar. 26, 2015.

BACKGROUND

Technical Field

The present utility model relates to a cup holder, and in particular to a cooling cup holder that is suitable for chairs including massage armchairs, sofas and seats in coaches, airplanes, ships, theaters and cinemas.

Related Art

The patent for utility model with Patent No. 201020541343.6 discloses a "MULTI-FUNCTIONAL TOUCH COOLING CUP HOLDER". The cup holder can be equipped in seats, including massage armchairs, sofas and seats in coaches, airplanes, ships, theaters and cinemas. It can cool drinks to provide cool drinks for people in hot weather. However, the cooling cup holder is open, and it is easy for dust and other sundry crumbs to drop into the cup holder, thus bringing about trouble to cleaners.

SUMMARY

An objective of the present utility model is to provide a cooling cup holder with a rotary flip so as to overcome the defects in the prior art, so that the cooling cup holder can be covered when it is unnecessary to cool a drink, and the cooling cup holder can be open when it is necessary to cool a drink, thus keeping hygiene of the cooling cup holder.

Another objective of the present utility model is that, in addition to the above objective, various functions in a seat can be controlled through the cooling cup holder, including motor variation, the ON/OFF of headlight or footlight, heating and push rod expansion and contraction.

In order to achieve the first objective, the following technical solution can be adopted: the cooling cup holder with a rotary flip in the solution, like the prior art, includes a cup holder, wherein the cup holder includes a circular socket that can accommodate a beverage can or a beverage bottle or a water cup, a lower end of the circular socket is provided with an annular bottom cap, and a lower portion of an inner bore of the bottom cap has an annular shallow slot which is slightly larger than the inner bore; further includes a thermal conductive plate, wherein the thermal conductive plate is in a shape of a shallow plate turned upside down, and a plate edge thereof is embedded in the annular shallow slot of the lower portion of the inner bore of the bottom cap; further includes a thermoelectric cooler, wherein the thermoelectric cooler is installed between a thermal radiator described below and the thermal conductive plate and is electrically connected with a control circuit in a control circuit board, a side of a thermoelectric cooler can face toward the thermal conductive plate; and further includes a thermal radiator, wherein the thermal radiator includes a plurality of radiation fins which are in parallel and a cooling fan, and is installed under the bottom cap; and improvements thereof are as follows:

middle portions of left and right side faces of the circular socket in the cup holder each are provided with a raised large cylinder with a blind hole in the center, the two large cylinders being symmetric with each other, and each of the two blind holes is provided with a metal nut; upper and lower positions of a rear portion of each of the large cylinders each are provided with a raised middle cylinder with a female threaded hole in the center, the middle cylinders being symmetric with each other; towards the top of a front portion of each of the large cylinders is a raised small cylinder I with a female threaded hole in the center, the small cylinders being symmetric with each other; a top plate I which has a large round hole in the center is further fixedly connected around the top portion of the circular socket, the periphery of the top plate being rectangular; on a bottom surface of the rectangular top plate I, near a rear side edge thereof is a row of female threaded holes where a rear side frame described below is assembled; on the bottom surface of the rectangular top plate I, left and right sides near a front side edge thereof each are provided with a pair of downwardly raised small cylinders II with female threaded holes in the centers respectively; a pair of rib plates with vertical slots are further disposed in the middle of the two pairs of small cylinders II, and the two vertical slots are opposite and notched inwardly; and an upper surface of the rectangular top plate I is fixedly connected with a frame, the frame including:

a left side plate and a right side plate vertically fixedly connected with left and right side edges of the rectangular top plate I respectively, wherein top surfaces of the left side plate and the right side plate each are further fixedly connected with a rectangular ring plate extending outwardly, and projection of front and rear side edges of rectangular holes in the rectangular ring plate in a vertical direction is an appropriate distance longer than projection of the front and rear side edges of the rectangular top plate I in the vertical direction; and four sides of the rectangular ring plate each are fixedly connected with a short bent edge extending downwardly;

a rear side frame, wherein the rear side frame includes a bottom slat, and a row of screw holes corresponding to the row of female threaded holes in the rectangular top plate I are disposed near a front side edge of the bottom slat; left and right side edges of the bottom slat each are fixedly connected with a left side slat and a right side slat vertically upward, a rear side edge of the bottom slat is fixedly connected with a rear wallboard vertically upward, and the rear wallboard is fixedly connected with and is as high as the left side slat and the right side slat;

wherein left and right sides of the bottom cap near the front of a transverse center line thereof each are provided with a notch, and a limiting step is disposed in each notch; left and right sides directly in front of an outer circle of the bottom cap each are provided with a raised small cylinder VII with a female thread hole in the center; further including:

a rotary flip, the rotary flip including:

a rotary face shell, wherein the rotary face shell includes a rectangular top plate II, and four sides of the rectangular top plate II each are provided with a downward bent edge, wherein the height of the bent edge of the rear side edge is properly greater than the height of the bent edge of the front side edge and the height of the bent edges of the left and right side edges, and the height of a rear portion of each of the bent edges of the left and right side edges is equal to the height of the bent edge of the rear side edge; left and right sides of an inner surface of the bent edge of the rear side edge are provided with a pair of raised small cylinders III where a touch circuit board A bracket described below is assembled, the small cylinders having female threaded holes in the centers; an outer surface of the bent edge of the rear side edge is provided with a cooling key icon fitting in with a touch circuit board A described below; a rear portion of a bottom surface of the rectangular top plate II is provided with a row of three raised small cylinders mutually bolted with a flip bottom shell described below and having female threaded holes in the centers, and left and right sides near a front end of the bottom surface of the rectangular top plate II each are provided with a small cylinder IV mutually bolted with a flip bottom shell described below and having a female threaded hole in the center; and further including a flip panel, wherein the flip panel is a thin plastic plate which is as big as the rectangular top plate II, a cooling key icon fitting in with a touch circuit board B described below is disposed near a front edge of the flip panel, and a row of English words "PUSH TO OPEN" are written near a rear edge of the flip panel; and the flip panel is stuck to a top surface of the rectangular top plate II of the rotary face shell;

a flip bottom shell that can be mutually buckled with the rotary face shell, wherein the flip bottom shell includes a left side plate and a right side plate, the left side plate and the right side plate respectively include a bar-like vertical plate, a front end of the bar-like vertical plate is fixedly connected with a small rectangular vertical plate which slightly protrudes downwardly, and a rear end of the bar-like vertical plate is fixedly connected with a large rectangular vertical plate which protrudes downwardly; front ends, rear ends and lower ends of the two small rectangular vertical plates on left and right sides are fixedly connected into a small rectangular box respectively by using a transverse slat; at front ends of the two large rectangular vertical plates on the left and right sides, front end faces thereof are fixedly connected by using a transverse slat, lower ends of the two large rectangular vertical plates are fixedly connected by using a rectangular flat plate, and the rectangular flat plate extends backwardly an appropriate distance longer than rear end faces of the large rectangular vertical plates; and further including a top plate, wherein the top plate fixedly connects upper end faces of the bar-like vertical plates on the left and right sides together; left and right sides of a front end face near a bottom surface of the small rectangular box each are provided with a screw hole corresponding to the small cylinder IV; on a top surface of the rectangular flat plate, near a front end thereof are a row of raised small cylinders V with female threaded holes in the centers, the small cylinders corresponding to the three small cylinders in the rotary face shell; middle positions between the three small cylinders V each are provided with a small cylinder VIII with a female threaded hole in the center; and left and right sides near a front portion of the top plate each are provided with at least two raised small cylinders VI with female threaded holes in the centers, a left rotating arm and a right rotating arm being assembled at the small cylinders;

a touch circuit board A bracket, wherein the touch circuit board A bracket includes a cross bar, two ends of the cross bar each are fixedly connected with a small round socket, and a center distance of the two small round sockets is equal to a center distance of the two small cylinders III with female threaded holes in the centers in the rotary face shell; and two ejecting blocks are disposed in the middle of the cross bar;

an elongated touch circuit board A, wherein the touch circuit board A uses two screws to pass through inner bores of the small round sockets in the touch circuit board A bracket, to be tightened into the female threaded holes in the centers of the two small cylinders III in the rotary face shell, and front ends of the ejecting blocks tightly abut against the back of the touch circuit board A;

a touch circuit board B, wherein the touch circuit board B is assembled onto a bottom plate in the small rectangular box in the flip bottom shell;

a backlight pressing block, wherein the backlight pressing block includes a small round socket, the front of the small round socket is fixedly connected with a vertical arm, and a lower side of the vertical arm is fixedly connected with a pressing block; further including:

a backlight, wherein the backlight is placed at a rear portion of the top surface of the rectangular flat plate in the flip bottom shell, and uses two screws to pass through inner bores of the small round sockets in the backlight pressing blocks, to be tightened into the female threaded holes in the centers of the small cylinders VIII in the flip bottom shell, and the pressing block in the backlight pressing block compresses the backlight tightly;

a left rotating arm, wherein the left rotating arm includes a rectangular mounting substrate, and at least two screw holes are disposed on the mounting substrate; a bending arm similar to a "C" shape is fixedly connected to a bottom surface of the mounting substrate, and a touch block is disposed in the middle of a right side of the bending arm; a lower end of the bending arm is fixedly connected with a circular ring, and an aperture of an inner bore of the circular ring fits in with an outer diameter of the large cylinder in the circular socket in the cup holder; a left side of the circular ring is provided with a circular recess, a small notch is further disposed in the middle of a junction between the recess and the bending arm, and a circular arc notch is cut in a front portion of an outer wall of the recess; and a lower-middle portion of an outer circle of the circular ring is further fixedly connected with a quadrant;

a right rotating arm, wherein the structure of the right rotating arm is symmetric with that of the left rotating arm, and the right rotating arm and the left rotating arm are of the same size;

wherein at least four screws are used to respectively pass through screw holes on substrates of the left rotating arm and the right rotating arm, and are tightened into the female threaded holes in the centers of the small cylinders VI in the flip bottom shell, to assemble the left rotating arm and the right rotating arm on a lower surface of the top plate in the flip bottom shell;

the rotary face shell is buckled on the flip bottom shell, wherein rear end faces of the large rectangular vertical plates on the left side and the right side of the flip bottom shell are connected to front end faces of rear portions of the bent edges of the left and right side edges in the rotary face shell, and a rear end face of the rectangular flat plate in the flip bottom shell is aligned with the bent edge of the rear side edge in the rotary face shell; a front end face of the small box in the flip bottom shell is aligned with a front end face of the bent edge of the front side edge of the rectangular top plate II in the rotary face shell; three screws are used to pass through the screw holes in the centers of the small cylinders in the rotary face shell from top to bottom to be respectively tightened into the female threaded holes in the centers of the three small cylinders V in the flip bottom shell; two screws are used to pass through, from the bottom up, the screw holes on the left and right sides of the front end face near the bottom surface of the small rectangular box in the flip bottom shell to be respectively tightened into the female threaded holes in the centers of the two small cylinders IV in the rotary face shell, so as to assemble the rotary face shell and the flip bottom shell together, to form the rotary flip;

a left-handed torsion spring, wherein the left-handed torsion spring is assembled into the circular recess of the left rotating arm;

a right-handed torsion spring, wherein the right-handed torsion spring is assembled into the circular recess of the right rotating arm;

two damper brackets, wherein each damper bracket includes a circular ring, upper and lower sides of the circular ring each are fixedly connected with an ear plate, the right side of the circular ring is further provided with a circular step recessed inwardly, upper and lower sides of the circular step each are fixed with a rectangular shallow recess, the two recesses being symmetric with each other, the middle of each of the two rectangular shallow recesses is provided with a female threaded hole, the two female threaded holes being symmetric with each other, on reverse sides of the two ear plates, upper and lower sides of the two female threaded holes 44 each are provided with a raised small circular ring, the small circular rings being symmetric with each other, an inner diameter of each of the small circular rings fits in with an outer diameter of each of the middle cylinders of the circular socket in the cup holder, and the center of each of the small circular rings is provided with a screw hole;

two dampers, wherein each damper includes a small circular plate, outer diameters of the small circular plates fit in with inner bores of the circular rings in the damper brackets; upper and lower sides near the right sides of the small circular plates each are fixedly connected with a small ear plate, shapes and thicknesses of the small ear plates fit in with the rectangular shallow recesses in the damper brackets, the small ear plates each are provided thereon with a screw hole, and positions of the screw holes correspond to the female threaded holes in the rectangular shallow recesses in the damper brackets; the center of each of the small circular plates is fixedly provided with a small mandrel which protrudes backwardly, a pinion is fixedly installed on the small mandrel, and the modulus of the pinion is the same as that of teeth of the quadrant in the flip bottom shell of the rotary flip;

two spring pressing plates, wherein each spring pressing plate includes a small disk, the center of the right side of the small disk has a countersunk screw hole, a raised circular ring is disposed on the back of the small disk and outside the countersunk screw hole, and an inner circle diameter of the raised circular ring fits in with an outer diameter of the large cylinder in the circular socket of the cup holder; an upper end of the small disk is fixedly connected with a short arm, an upper end of the short arm is fixedly connected with a small cylinder, and the center of the small cylinder has a screw hole; a raised small circular ring is disposed on the back of the small disk and outside the screw hole, and an inner circle diameter of the small circular ring fits in with an outer diameter of the small cylinder I in the circular socket of the cup holder; and the middle of the back of the short arm is further provided with a vertical slot;

two self-locking switch brackets, wherein each self-locking switch bracket includes a block, left and right sides of the block each are fixedly connected with an ear plate, the middle of each ear plate has a screw hole, and a center distance of the two screw holes is equal to a center distance of each pair of small cylinders II in the circular socket of the cup holder; a front side and a rear side between the ear plate on the right side and the block each are provided with a right-angled trapezoid vertical plate which extends downwardly, and the two right-angled trapezoid vertical plates are connected through a rib plate; and the two self-locking switch brackets use two pairs of screws to pass through the screw holes on the ear plates respectively to be tightened into the female threaded holes in the centers of each pair of small cylinders II in the circular socket of the cup holder;

two self-locking switches, wherein the two self-locking switches are respectively installed onto the two self-locking switch brackets, and during assembly, bottom surfaces thereof are adhered to lower end faces of the blocks of the self-locking switch brackets, and one side thereof is adhered to a vertical end face of the right-angled trapezoid vertical plates;

a rectangular control circuit board, wherein a control circuit in the control circuit board includes a main control MCU, an input end of the main control MCU is in signaling connections with the touch circuit board A and the touch circuit board B respectively, and an output end thereof is respectively in signaling connections with the backlight and a cooler control module of a control circuit in a control circuit board of a seat; a power module supplies power for the main control MCU, the backlight and the cooler control module respectively; two sides of the control circuit board near a lower end thereof each are provided with a screw hole; an upper end of the control circuit board is inserted into the vertical slots of a pair of rib plates with vertical slots in the front of the circular socket in the cup holder, and then uses two screws to pass through the screw holes on the two sides near the lower end thereof, to be tightened into the female threaded holes in the centers of the two small cylinders VII directly in front of the bottom cap;

the rotary flip penetrates from the rectangular holes of the rectangular ring plate in the frame of the cup holder, and the inner bores of the circular rings in the left rotating arm and the right rotating arm each are sheathed outside the large cylinders on the left and right sides of the circular socket in the cup holder; the left-handed torsion spring and the right-handed torsion spring are respectively nested in the circular recesses on the left side faces of the circular rings in the left rotating arm and the right rotating arm, and one ends thereof extend out of the notches of the recesses; the small disks in the two spring pressing plates are buckled outside the large cylinders, the other ends of the left-handed torsion spring and the right-handed torsion spring respectively extend into the vertical slot on the back of the short arms in the spring pressing plates, two screws are used to respectively pass through the countersunk screw holes in the centers of the small disks in the spring pressing plates on the left and right sides, to be tightened into the metal nuts in the blind holes in the centers of the large cylinders on the left and right sides of the circular socket in the cup holder, to respectively hold the left-handed torsion spring and the right-handed torsion spring down; inner circles of the raised small circular rings on the backs of the small cylinders in the two spring pressing plates are buckled outside the small cylinders I in the circular socket in the cup holder, and two screws are used to respectively pass through the screw holes in the centers of the small cylinders, to be tightened into the female threaded holes in the centers of the small cylinders I on the left and right sides of the circular socket in the cup holder; the two dampers each are inserted from the right sides of the two damper brackets, wherein the pinions are engaged with the teeth of the quadrant in the flip bottom shell, two pairs of small screws are used to respectively pass through the screw holes in the small ear plates of the two dampers, to be tightened into the female threaded holes in the rectangular recesses on the right sides of the ear plates of the damper brackets, so as to assemble the dampers and the damper brackets together, at the same time, the small circular rings on the backs of the ear plates in the damper brackets are sheathed outside the middle cylinders on the left and right sides of the circular socket in the cup holder, and then two pairs of screws are used to pass through the screw holes on the ear plates, to be tightened into the female threaded holes in the centers of the middle cylinders, so as to well assemble the dampers and the damper brackets together; and the rotary flip can rotate at an appropriate angle around central axes of the large cylinders on the left and right sides of the circular socket in the cup holder, when the rotary slip rotates to the flip panel therein to be flush with the top surface of the rectangular ring plate in the cup holder, and when the position of "PUSH TO OPEN" in the rear edge of the flip panel is slightly pressed down, touch blocks on the bending arms in the left rotating arm and the right rotating arm touch the self-locking switches, the self-locking switches control the main control MCU to be disconnected from the backlight, at this time, the rotary flip seals the rectangular holes of the rectangular ring plate in the frame of the cup holder and the position of the rotary flip is stabilized, when the position of "PUSH TO OPEN" in the rear edge of the flip panel is slightly pressed down once again, elastic forces of the left-handed torsion spring and the right-handed torsion spring overturn the rotary flip by 90°, when the touch blocks touch the limiting steps in the notches on the left and right sides of the bottom cap, the touch blocks no longer rotate, at this time, the self-locking switches control the main control MCU to be connected with the backlight, the backlight emits light, the circular socket in the cup holder is exposed, and the key icon on the outer surface of the bent edge of the rear side edge in the rotary face shell is just located thereon.

In order to achieve the second objective, the following improvements can be made on the basis of the aforementioned technical solution:

The output end of the main control MCU in the control circuit of the control circuit board is further in signaling connections with various functional control modules in a total control circuit in a seat respectively, and the functional control modules include a motor vibration control module, a headlight or footlight control module, a heating control module and a push rod expansion and contraction control module; and touch key icons with various functions which are in the same row as the cooling key icon and control a seat are disposed near the front edge of the flip panel in the flip face shell and on the outer surface of the bent edge of the rear side edge of the flip face shell, the touch key icons including icons of motor vibration, the ON/OFF of headlight or footlight, heating and push rod expansion and contraction.

Various functions in the seat can be controlled by pressing the touch key icons on the outer surface of the bent edge of the rear side edge of the flip face shell.

Beneficial effects of the present utility model are as follows:

1. The cooling cup holder can be covered when it is unnecessary to cool a drink, and the cooling cup holder can be open when it is necessary to cool a drink, thus keeping hygiene of the cooling cup holder.

2. When the backlight in the cooling cup holder emits light, the circular socket in the cup holder can be lit up, which facilitates a consumer to find his/her position and also increases the sense of beauty.

3. Various functions in the seat can be controlled by pressing the touch key icons in the cooling cup holder, and thus it is unnecessary to otherwise assemble control keys on the seat.

In order to make the present utility model easy to understand and much clearer, the present utility model is further described below with reference to the accompanying drawings and embodiments.

DETAILED DESCRIPTION

Figure 1:
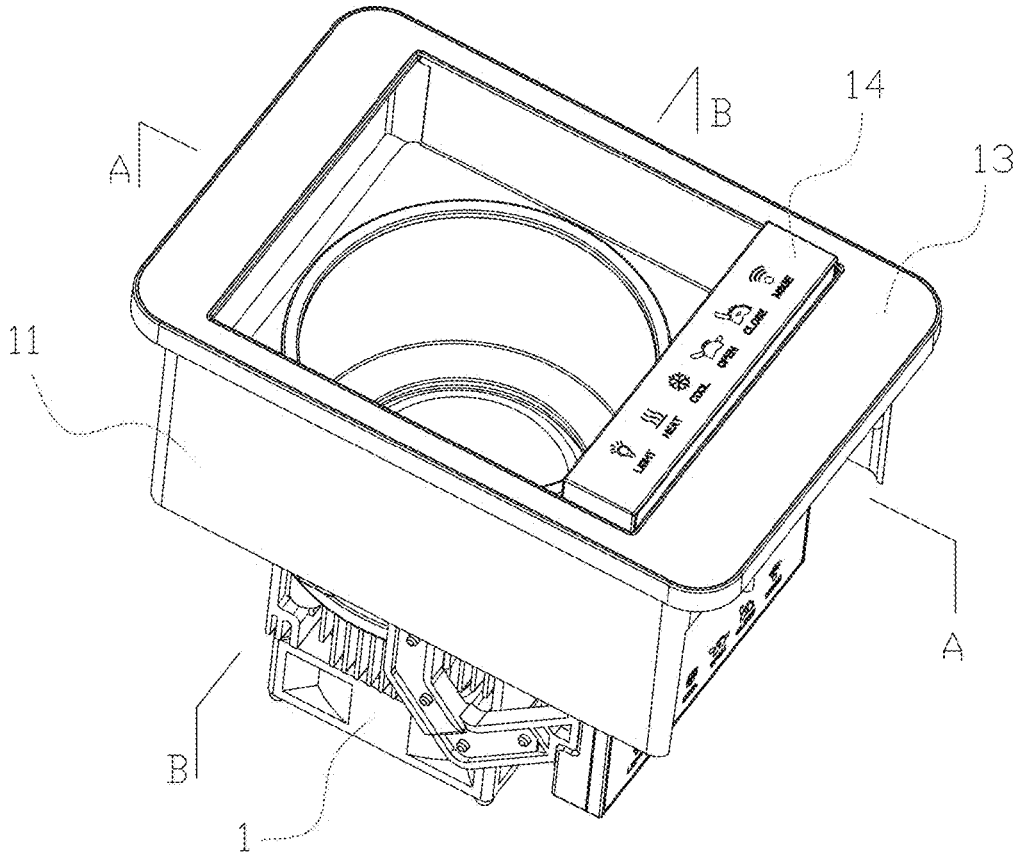
FIG. 1 is a first three-dimensional schematic view of a contour according to an embodiment of the present utility model.
Figure 2:
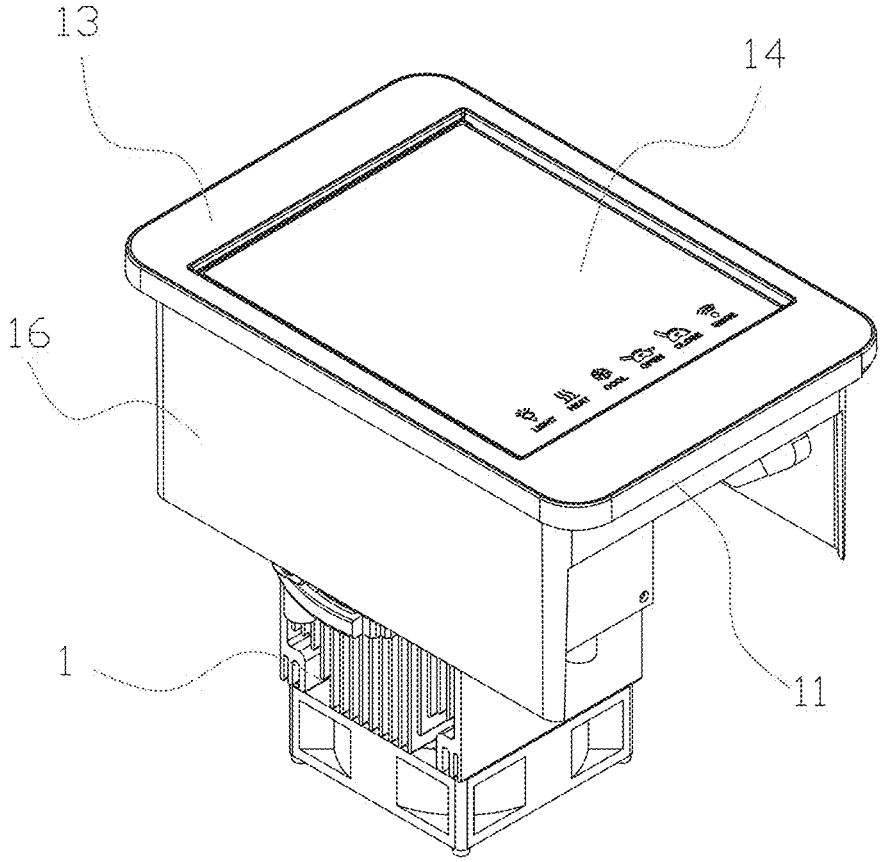
FIG. 2 is a second three-dimensional schematic view of a contour according to an embodiment of the present utility model.
Figure 3:
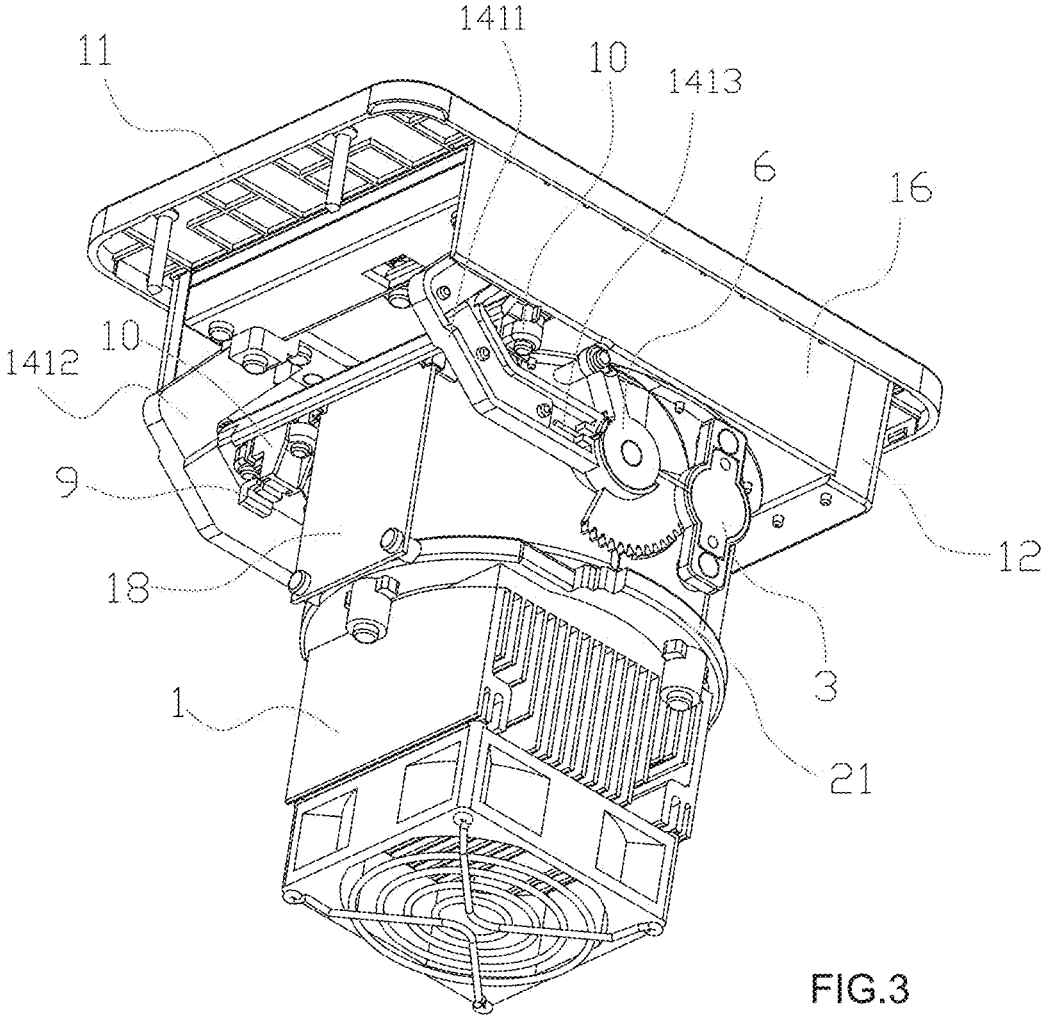
FIG. 3 is a third three-dimensional schematic view of a contour according to an embodiment of the present utility model.
Figure 15:
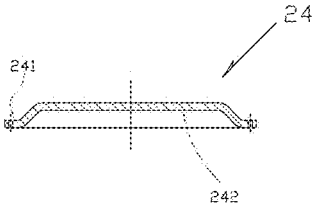
FIG. 15 is a schematic sectional view of the thermal conductive plate in FIG. 3.
Figure 16A:
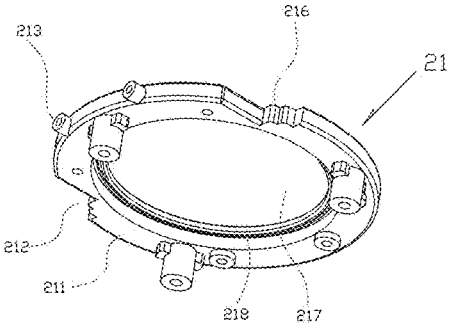
FIG. 16*a* is a three-dimensional schematic view of the bottom cap in FIG. 3.
Figure 16B:
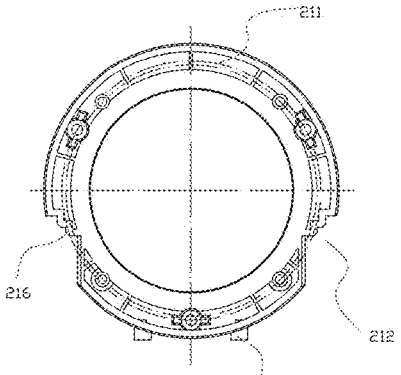
FIG. 16*b* is a schematic top view of FIG. 16*a;*
Figure 17:
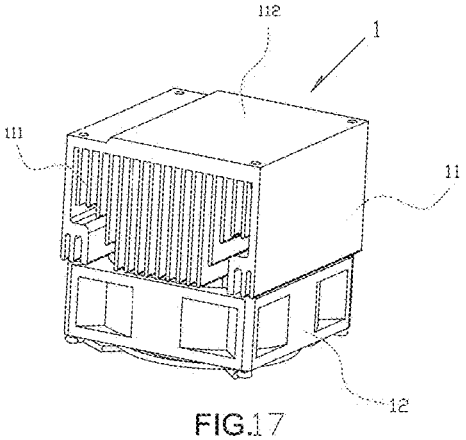
FIG. 17 is a three-dimensional schematic view of the thermal radiator in FIG. 3.
Figure 18:
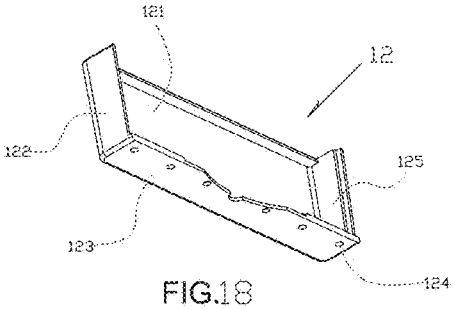
FIG. 18 is a three-dimensional schematic view of the rear side frame in FIG. 3.
Figure 19A:
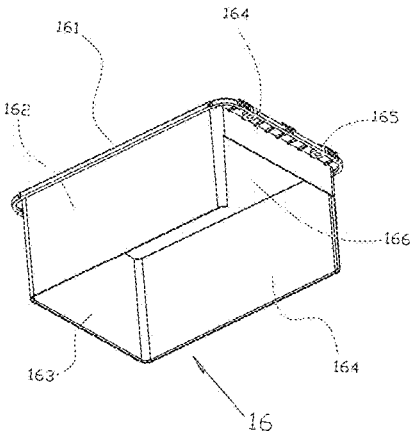
FIG. 19*a* is a three-dimensional schematic view of the rectangular socket in FIG. 3.
Figure 19B:
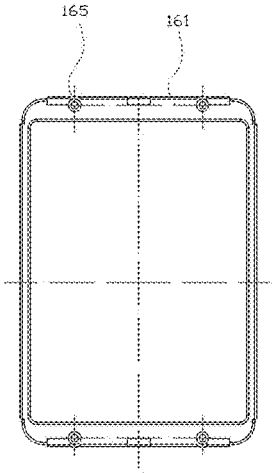
FIG. 19*b* is a schematic top view of FIG. 19*a*.
Figure 19C:
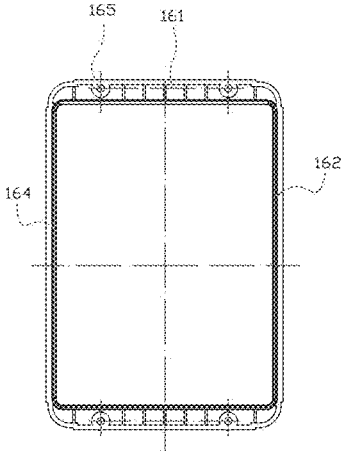
FIG. 19*c* is a schematic rear view of FIG. 19*b;*

Embodiment 1 please refer to FIG. 1 to FIG. 27. In this embodiment, the cooling cup holder with a rotary flip includes a cup holder 11 (refer to FIG. 1, FIG. 2 and FIG. 3), wherein the cup holder 11 includes a circular socket 115 that can accommodate a beverage can or a beverage bottle or a water cup (refer to FIG. 9*a* to FIG. 9*g*), a lower end of the circular socket 115 is provided with an annular bottom cap 21 by using three screws 22 (refer to FIG. 16*a* and FIG. 16*b* and FIG. 7, FIG. 4), and a lower portion of an inner bore 217 of the bottom cap 21 has an annular shallow slot 218 which is slightly larger than the inner bore; further including a thermal conductive plate 24 (refer to FIG. 15 and FIG. 7), wherein the thermal conductive plate 24 is in a shape of a shallow plate turned upside down, and a plate edge 241 thereof is embedded in the annular shallow slot 218 of the lower portion of the inner bore 217 of the bottom cap by using four screws 20; further including a thermoelectric cooler 25 (refer to FIG. 4 and FIG. 7), wherein the thermoelectric cooler 25 is installed between a thermal radiator 1 described below and the thermal conductive plate 24 and is electrically connected with a control circuit in a control circuit board 18, a side of the thermoelectric cooler 25 faces up and is adhered to a bottom side 242 of the thermal conductive plate 24, and another side faces down and is adhered to a top side 112 of the thermal radiator 1; and further including a thermal radiator 1 (refer to FIG. 17 and FIG. 7), wherein the thermal radiator 1 includes a plurality of radiation fins 11 which are in parallel and a cooling fan 12, and is installed under the bottom cap 21; wherein:

middle portions of left and right side faces of the circular socket 115 in the cup holder 11 each are provided with a raised large cylinder 117 with a blind hole 1171 in the center, the two large cylinders being symmetric with each other, and each of the two blind holes 1171 is provided with a metal nut 28 (refer to FIG. 8); upper and lower positions of a rear portion of each of the large cylinders 117 each are provided with a raised middle cylinder 116 with a female threaded hole in the center, the middle cylinders being symmetric with each other; towards the top of a front portion of each of the large cylinders 117 is a raised small cylinder I 118 with a female threaded hole in the center, the small cylinders being symmetric with each other; a top plate I 113 which has a large round hole 1131 in the center is further fixedly connected around the top portion of the circular socket 115, the periphery of the top plate being rectangular; on a bottom surface of the rectangular top plate I 113, near a rear side edge thereof is a row of female threaded holes 1113 where a rear side frame 12 described below is assembled; on the bottom surface of the rectangular top plate I 113, left and right sides near a front side edge thereof each are provided with a pair of downwardly raised small cylinders II 119 with female threaded holes in the centers respectively; a pair of rib plates 1111 with vertical slots are further disposed in the middle of the two pairs of small cylinders II 119, and the two vertical slots are opposite and notched inwardly; and an upper surface of the rectangular top plate I 113 is fixedly connected with a frame, the frame including:

a left side plate 112 and a right side plate 114 vertically fixedly connected with left and right side edges of the rectangular top plate I 113 respectively, wherein top surfaces of the left side plate 112 and the right side plate 114 each are further fixedly connected with a rectangular ring plate 111 extending outwardly, and projection of front and rear side edges of rectangular holes 1112 in the rectangular ring plate 111 in a vertical direction is an appropriate distance longer than projection of the front and rear side edges of the rectangular top plate I 113 in the vertical direction; and four sides of the rectangular ring plate 111 each are fixedly connected with a short bent edge 1114 extending downwardly;

a rear side frame 12 (refer to FIG. 4 and FIG. 18), wherein the rear side frame 12 includes a bottom slat 123, and a row of screw holes 124 corresponding to the row of female threaded holes 1113 in the rectangular top plate I are disposed near a front side edge of the bottom slat 123; left and right side edges of the bottom slat 123 each are fixedly connected with a left side slat 122 and a right side slat 125 vertically upward, a rear side edge of the bottom slat 123 is fixedly connected with a rear wallboard 121 vertically upward, and the rear wallboard 121 is fixedly connected with and is as high as the left side slat 122 and the right side slat 125;

wherein left and right sides of the bottom cap 21 near the front of a transverse center line thereof each are provided with a notch 216, and a limiting step 212 is disposed in each notch 216; left and right sides directly in front of an outer circle of the bottom cap 21 each are provided with a raised small cylinder VII 213 with a female thread hole in the center; further including:

a rotary flip 14, the rotary flip 14 including (refer to FIG. 1 to FIG. 8 and FIG. 20*a* to FIG. 26*d*):

a rotary face shell 143 (refer to FIG. 20*a* to FIG. 20*d*), wherein the rotary face shell 143 includes a rectangular top plate II 14311, and four sides of the rectangular top plate II 14311 each are provided with a downward bent edge, wherein the height of the bent edge 1433 of the rear side edge is properly greater than the height of the bent edge 1431 of the front side edge and the height of the bent edges of the left and right side edges, and the height of a rear portion 1432 of each of the bent edges of the left and right side edges is equal to the height of the bent edge 1433 of the rear side edge; left and right sides of an inner surface of the bent edge 1433 of the rear side edge are provided with a pair of raised small cylinders III 1434 where a touch circuit board A bracket 145 described below is assembled, the small cylinders having female threaded holes in the centers; an outer surface of the bent edge 1433 of the rear side edge is provided with a cooling key icon 14312 fitting in with a touch circuit board A 146 described below; a rear portion of a bottom surface of the rectangular top plate II 14311 is provided with a row of three raised small cylinders 1435 mutually bolted with a flip bottom shell 1416 described below and having female threaded holes in the centers, and left and right sides near a front end of the bottom surface of the rectangular top plate II 14311 each are provided with a small cylinder IV 1439 mutually bolted with a flip bottom shell 1416 described below and having a female threaded hole in the center; and further including a flip panel 141 (refer to FIG. 24), wherein the flip panel 141 is a thin plastic plate 1411 which is as big as the rectangular top plate II 14311, a cooling key icon 1412 fitting in with a touch circuit board B 1418 described below is disposed near a front edge of the flip panel 141, and a row of English words "PUSH TO OPEN" 1413 are written near a rear edge of the flip panel 141; and the flip panel 141 is stuck to a top surface of the rectangular top plate II 14311 of the rotary face shell 143;

a flip bottom shell 1416 that can be mutually buckled with the rotary face shell 143, wherein the flip bottom shell 1416 (refer to FIG. 21*a* to FIG. 21*d*) includes a left side plate and a right side plate, the left side plate and the right side plate respectively include a bar-like vertical plate 14161, a front end of the bar-like vertical plate 14161 is fixedly connected with a small rectangular vertical plate 141610 which slightly protrudes downwardly, and a rear end of the bar-like vertical plate 14161 is fixedly connected with a large rectangular vertical plate 14162 which protrudes downwardly; front ends, rear ends and lower ends of the two small rectangular vertical plates 141610 on left and right sides are fixedly connected into a small rectangular box 14169 respectively by using a transverse slat; at front ends of the two large rectangular vertical plates 14162 on the left and right sides, front end faces thereof are fixedly connected by using a transverse slat, lower ends of the two large rectangular vertical plates 14162 are fixedly connected by using a rectangular flat plate 14163, and the rectangular flat plate 14163 extends backwardly an appropriate distance longer than rear end faces of the large rectangular vertical plates 14162; and further including a top plate 14165, wherein the top plate 14165 fixedly connects upper end faces of the bar-like vertical plates 14161 on the left and right sides together; left and right sides of a front end face near a bottom surface 14162 of the small rectangular box 14169 each are provided with a screw hole 14167 corresponding to the small cylinder IV 1439; on a top surface of the rectangular flat plate 14163, near a front end thereof are a row of raised small cylinders V 141615 with female threaded holes in the centers thereof, the small cylinders corresponding to the three small cylinders 1435 in the rotary face shell 143; middle positions between the three small cylinders V 141615 each are provided with a small cylinder VIII 141614 with a female threaded hole in the center; and left and right sides near a front portion of the top plate 14165 each are provided with at least two raised small cylinders VI 14166 with female threaded holes in the centers, a left rotating arm 1412 and a right rotating arm 1411 being assembled at the small cylinders;

a touch circuit board A bracket 145, wherein the touch circuit board A bracket 145 includes a cross bar 1453, two ends of the cross bar 1453 each are fixedly connected with a small round socket 1452, and a center distance of the two small round sockets 1452 is equal to a center distance of the two small cylinders III 1434 with female threaded holes in the centers in the rotary face shell 143; and two ejecting blocks 1453 are disposed in the middle of the cross bar 1451;

an elongated touch circuit board A 146 (refer to FIG. 6), wherein the touch circuit board A 146 uses two screws 144 to pass through inner bores of the small round sockets 1452 in the touch circuit board A bracket, to be tightened into the female threaded holes in the centers of the two small cylinders III 1434 in the rotary face shell 143, and front ends of the ejecting blocks 1453 tightly abut against the back of the touch circuit board A 146;

a touch circuit board B 1418 (refer to FIG. 6), wherein the touch circuit board B 1418 is assembled onto a bottom plate 141612 in the small rectangular box 14169 in the flip bottom shell 1416;

a backlight pressing block 148 (refer to FIG. 22), wherein the backlight pressing block 148 includes a small round socket 1481, the front of the small round socket 1481 is fixedly connected with a vertical arm 1482, and a lower side of the vertical arm 1482 is fixedly connected with a pressing block 1483; further including:

a backlight 147 (refer to FIG. 6), wherein the backlight 147 is placed at a rear portion of the top surface of the rectangular flat plate 14163 in the flip bottom shell 1416, and uses two screws to pass through inner bores 1484 of the small round sockets in the backlight pressing blocks 148, to be tightened into the female threaded holes in the centers of the small cylinders VIII 141614 in the flip bottom shell 1416, and the pressing block 1483 in the backlight pressing block 148 compresses the backlight 147 tightly;

a left rotating arm 1412 (refer to FIG. 25*a* to FIG. 25*d*), wherein the left rotating arm 1412 includes a rectangular mounting substrate 14121, and at least two screw holes 14127 are disposed on the mounting substrate 14121; a bending arm 14122 similar to a "C" shape is fixedly connected to a bottom surface of the mounting substrate 14121, and a touch block 14123 is disposed in the middle of a right side of the bending arm 14122; a lower end of the bending arm 14122 is fixedly connected with a circular ring 14125, and an aperture of an inner bore of the circular ring 14125 fits in with an outer diameter of the large cylinder 117 in the circular socket 115 in the cup holder 11; a left side of the circular ring 14125 is provided with a circular recess 14126, a small notch 14127 is further disposed in the middle of a junction between the recess 14126 and the bending arm 14122, and a circular arc notch 14128 is cut in a front portion of an outer wall of the recess 14126; and a lower-middle portion of an outer circle of the circular ring 14125 is further fixedly connected with a quadrant 14124;

a right rotating arm 1411, wherein the structure of the right rotating arm 1411 is symmetric with that of the left rotating arm 1412, and the right rotating arm and the left rotating arm are of the same size;

wherein at least four screws 1415 (the number of the screws is not limited to four) are used to respectively pass through screw holes on substrates 14127 of the left rotating arm 1412 and the right rotating arm 1411, and are tightened into the female threaded holes in the centers of the small cylinders VI 14166 in the flip bottom shell 1416, to assemble the left rotating arm and the right rotating arm on a lower surface of the top plate 14165 in the flip bottom shell 1416;

the rotary face shell 143 is buckled on the flip bottom shell 1416, wherein rear end faces of the large rectangular vertical plates 14162 on the left side and the right side of the flip bottom shell 1416 are connected to front end faces of rear portions 1432 of the bent edges of the left and right side edges in the rotary face shell 143, and a rear end face of the rectangular flat plate 14163 in the flip bottom shell 1416 is aligned with the bent edge 1433 of the rear side edge in the rotary face shell 143; a front end face 14168 of the small box 14169 in the flip bottom shell 1416 is aligned with a front end face of the bent edge of the front side edge of the rectangular top plate II 14311 in the rotary face shell 143; three screws 142 are used to pass through the screw holes in the centers of the small cylinders 1435 in the rotary face shell 143 from top to bottom to be respectively tightened into the female threaded holes in the centers of the three small cylinders V 141615 in the flip bottom shell 1416; two screws are used to pass through, from the bottom up, the screw holes 14167 on the left and right sides of the front end face near the bottom surface of the small rectangular box 14169 in the flip bottom shell 1416 to be respectively tightened into the female threaded holes in the centers of the two small cylinders IV 1439 in the rotary face shell 143, so as to assemble the rotary face shell 143 and the flip bottom shell 1416 together, to form the rotary flip 14;

a left-handed torsion spring 1410 (refer to FIG. 6), wherein the left-handed torsion spring 1410 is assembled into the circular recess 14126 of the left rotating arm 1412;

a right-handed torsion spring 1413, wherein the right-handed torsion spring 1413 is assembled into the circular recess of the right rotating arm 1411;

two damper brackets 4 (refer to FIG. 10*a* and FIG. 10*b*), wherein each damper bracket 4 includes a circular ring 41, upper and lower sides of the circular ring 41 each are fixedly connected with an ear plate 42, the right side of the circular ring 41 is further provided with a circular step 46 recessed inwardly, upper and lower sides of the circular step 46 each are fixed with a rectangular shallow recess 45, the two recesses being symmetric with each other, the middle of each of the two rectangular shallow recesses 45 is provided with a female threaded hole 44, the two female threaded holes being symmetric with each other, on reverse sides of the two ear plates, upper and lower sides of the two female threaded holes 44 each are provided with a raised small circular ring 43, the small circular rings being symmetric with each other, an inner diameter of each of the small circular rings 43 fits in with an outer diameter of each of the middle cylinders 116 of the circular socket 115 in the cup holder 11, and the center of each of the small circular rings 43 is provided with a screw hole 47;

two dampers 3 (refer to FIG. 11), wherein each damper 3 includes a small circular plate 31, outer diameters of the small circular plates 31 fit in with inner bores of the circular rings 41 in the damper brackets 4; upper and lower sides near the right sides of the small circular plates 31 each are fixedly connected with a small ear plate 32, shapes and thicknesses of the small ear plates 32 fit in with the rectangular shallow recesses 45 in the damper brackets 4, the small ear plates 32 each are provided thereon with a screw hole 33, and positions of the screw holes 33 correspond to the female threaded holes 44 in the rectangular shallow recesses 45 in the damper brackets 4; the center of each of the small circular plates 31 is fixedly provided with a small mandrel 34 which protrudes backwardly, a pinion 35 is fixedly installed on the small mandrel 34, and the modulus of the pinion 35 is the same as that of teeth of the quadrant 14124 in the flip bottom shell 1416 of the rotary flip 14;

two spring pressing plates 6 (refer to FIG. 12*a* to FIG. 12*d*), wherein each spring pressing plate 6 includes a small disk 61, the center of the right side of the small disk 61 has a countersunk screw hole 62, a raised circular ring 68 is disposed on the back of the small disk and outside the countersunk screw hole 62, and an inner circle diameter of the raised circular ring 68 fits in with an outer diameter of the corresponding large cylinder 117 in the circular socket 115 of the cup holder 11; an upper end of the small disk 61 is fixedly connected with a short arm 63, an upper end of the short arm 63 is fixedly connected with a small cylinder 64, and the center of the small cylinder 64 has a screw hole 65; a raised small circular ring 66 is disposed on the back of the small disk 61 and outside the screw hole 65, and an inner circle diameter of the small circular ring 66 fits in with an outer diameter of the corresponding small cylinder I 118 in the circular socket 115 of the cup holder 11; and the middle of the back of the short arm 63 is further provided with a vertical slot 67;

two self-locking switch brackets 10 (refer to FIG. 13*a* to FIG. 13*d*), wherein each self-locking switch bracket 10 includes a block 102, left and right sides of the block 102 each are fixedly connected with an ear plate 101, the middle of each ear plate 101 has a screw hole 104, and a center distance of the two screw holes 104 is equal to a center distance of each pair of small cylinders II 119 in the circular socket 115 of the cup holder 11; a front side and a rear side between the ear plate on the right side and the block 102 each are provided with a right-angled trapezoid vertical plate 105 which extends downwardly, and the two right-angled trapezoid vertical plates 105 are connected through a rib plate 106; and the two self-locking switch brackets 10 use two pairs of screws 8 to pass through the screw holes 104 on the ear plates respectively to be tightened into the female threaded holes in the centers of each pair of small cylinders II 119 in the circular socket 115 of the cup holder 11;

two self-locking switches 9 (refer to FIG. 14), wherein the two self-locking switches 9 are respectively installed onto the two self-locking switch brackets 10, and during assembly, bottom surfaces thereof are adhered to lower end faces of the blocks of the self-locking switch brackets, and one side thereof is adhered to a vertical end face of the right-angled trapezoid vertical plates; the self-locking switches are preferably self-locking switches whose model is PR-07 produced by Dongguan Xi Bang Electronic Co., Ltd., and certainly, self-locking switches of other manufacturers are also feasible;

a rectangular control circuit board 18 (refer to FIG. 4), wherein a control circuit in the control circuit board 18 includes a main control MCU 182, an input end of the main control MCU 182 is in signaling connections with the touch circuit board A 146 and the touch circuit board B 1418 respectively, and an output end thereof is respectively in signaling connections with the backlight 147 and a cooler control module 186 of a control circuit in a control circuit board of a seat; a power module 181 supplies power for the main control MCU 182, the backlight 147 and the temperature control module 185 respectively; two sides of the control circuit board 18 near a lower end thereof each are provided with a screw hole; an upper end of the control circuit board 18 is inserted into the vertical slots of a pair of rib plates 1111 with vertical slots in the front of the circular socket 115 in the cup holder 11, and then uses two screws 19 to pass through the screw holes on the two sides near the lower end thereof, to be tightened into the female threaded holes in the centers of the two small cylinders VII 213 directly in front of the bottom cap 21;

the rotary flip 14 penetrates from the rectangular holes of the rectangular ring plate 111 in the frame of the cup holder 11, and the inner bores 14125 of the circular rings in the left rotating arm 1412 and the right rotating arm 1411 each are sheathed outside the large cylinders 117 on the left and right sides of the circular socket 115 in the cup holder 11; the left-handed torsion spring 1410 and the right-handed torsion spring 1413 are respectively nested in the circular recesses 14126 on the left side faces of the circular rings 14125 in the left rotating arm 1412 and the right rotating arm 1411, and one ends thereof extend out of the notches 14127 of the recesses; the small disks 61 in the two spring pressing plates 6 are buckled outside the large cylinders 117, the other ends of the left-handed torsion spring 1410 and the right-handed torsion spring 1413 respectively extend into the vertical slot 67 on the back of the short arms 63 in the spring pressing plates 6, two screws 7 are used to respectively pass through the countersunk screw holes 62 in the centers of the small disks in the spring pressing plates 6 on the left and right sides, to be tightened into the metal nuts 28 (refer to FIG. 8) in the blind holes in the centers of the large cylinders 117 on the left and right sides of the circular socket in the cup holder, to respectively hold the left-handed torsion spring and the right-handed torsion spring down; inner circles of the raised small circular rings 66 on the backs of the small cylinders 64 in the two spring pressing plates 6 are buckled outside the small cylinders I 118 in the circular socket in the cup holder, and two screws are used to respectively pass through the screw holes 65 in the centers of the small cylinders, to be tightened into the female threaded holes in the centers of the small cylinders I 118 on the left and right sides of the circular socket in the cup holder; the two dampers 3 each are inserted from the right sides of the two damper brackets 4, wherein the pinions 35 are engaged with the teeth of the quadrant 14124 in the flip bottom shell 1416, two pairs of small screws 2 are used to respectively pass through the screw holes 33 in the small ear plates of the two dampers 3, to be tightened into the female threaded holes 44 in the rectangular recesses on the right sides of the ear plates of the damper brackets 4, so as to assemble the dampers 3 and the damper brackets 4 together, at the same time, the small circular rings 43 on the backs of the ear plates in the damper brackets 4 are sheathed outside the middle cylinders 116 on the left and right sides of the circular socket in the cup holder, and then two pairs of screws 5 are used to pass through the screw holes 47 on the ear plates 42, to be tightened into the female threaded holes in the centers of the middle cylinders 116, so as to well assemble the dampers 3 and the damper brackets 4 together; and the rotary flip 14 can rotate at an appropriate angle around central axes of the large cylinders 117 on the left and right sides of the circular socket in the cup holder, when the rotary slip rotates to the flip panel 141 therein to be flush with the top surface of the rectangular ring plate 111 in the cup holder 11, and when the position of "PUSH TO OPEN" in the rear edge of the flip panel 141 is slightly pressed down, touch blocks 14123 on the bending arms in the left rotating arm 1412 and the right rotating arm 1411 touch the self-locking switches 9, the self-locking switches 9 control the main control MCU 182 to be disconnected from the backlight 147, at this time, the rotary flip 14 seals the rectangular holes of the rectangular ring plate 111 in the frame of the cup holder 11 and the position of the rotary flip is stabilized, when the position of "PUSH TO OPEN" in the rear edge of the flip panel is slightly pressed down once again, elastic forces of the left-handed torsion spring 10 and the right-handed torsion spring 13 overturn the rotary flip 14 by 90°, when the touch blocks 14123 touch the limiting steps 212 in the notches 216 on the left and right sides of the bottom cap 21, the touch blocks no longer rotate, at this time, the self-locking switches 9 control the main control MCU 182 to be connected with the backlight 147, the backlight 147 emits light, the circular socket 115 in the cup holder 11 is exposed, and the key icon 1433 on the outer surface of the bent edge of the rear side edge in the rotary face shell 143 is just located thereon.

Figure 4:
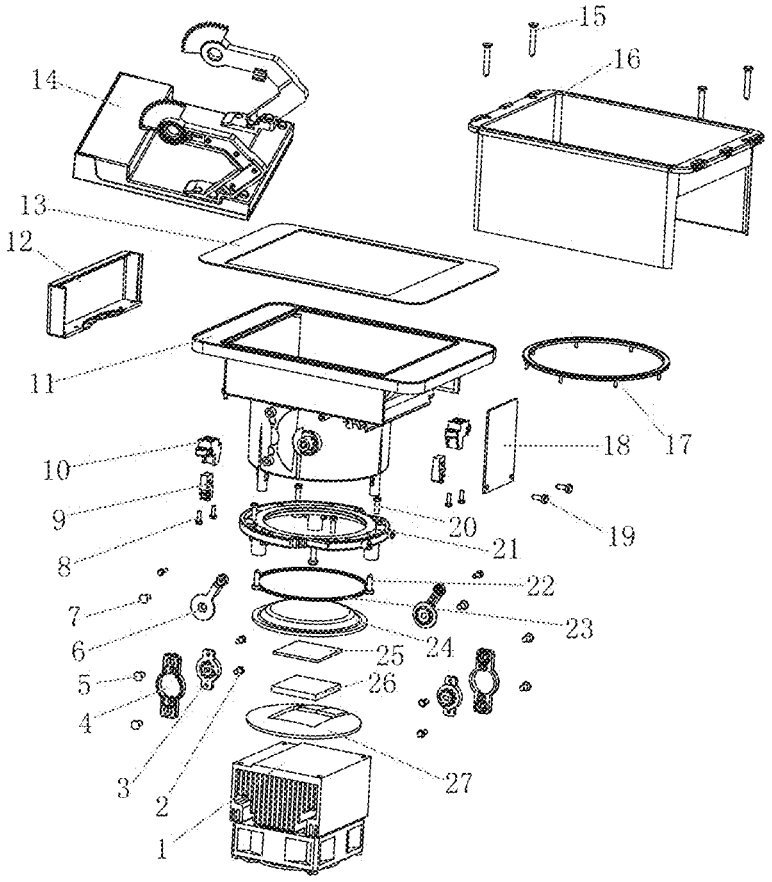
FIG. 4 is an exploded schematic view of various parts in FIG. 3.
Figure 5:
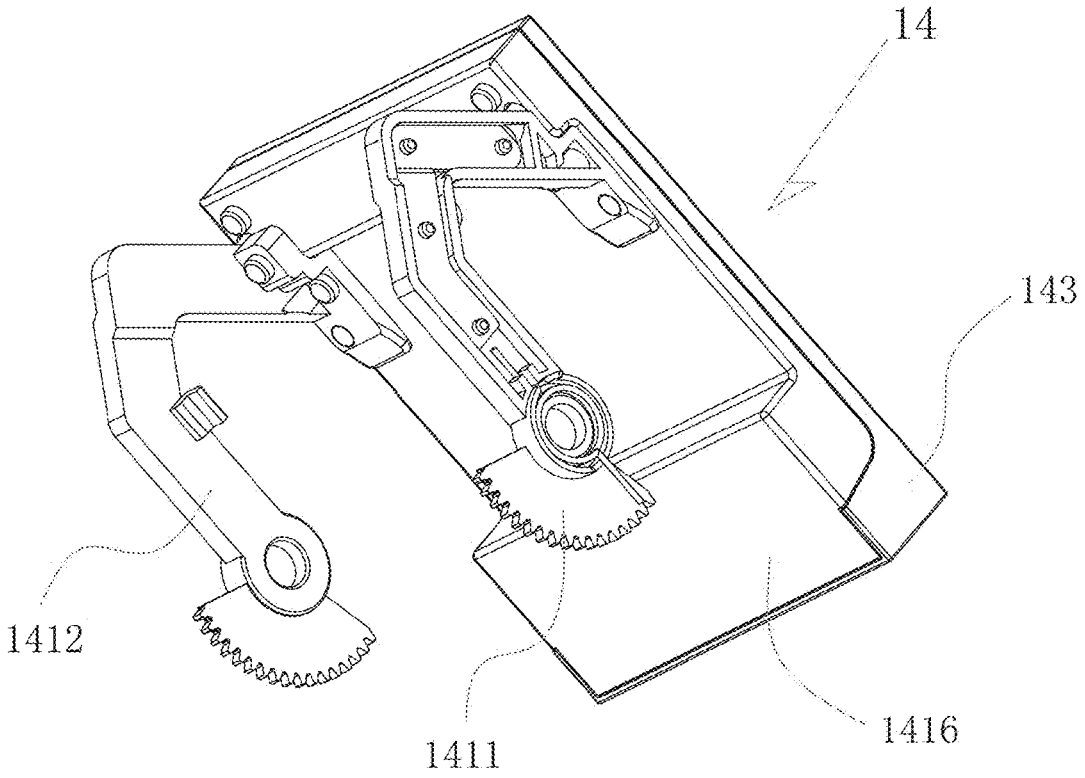
FIG. 5 is an enlarged three-dimensional schematic view of the rotary flip in FIG. 4.
Figure 6:
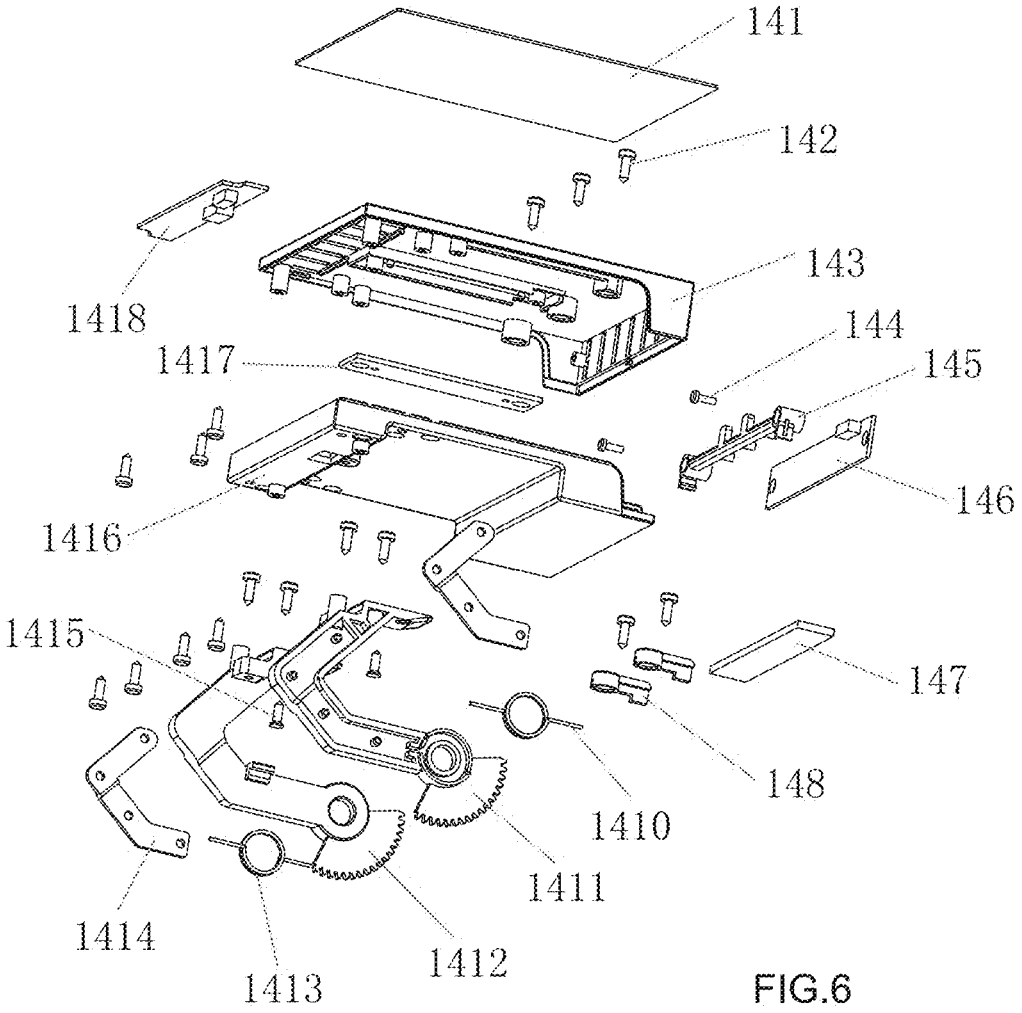
FIG. 6 is an exploded schematic view of various parts in FIG. 5.
Figure 7:
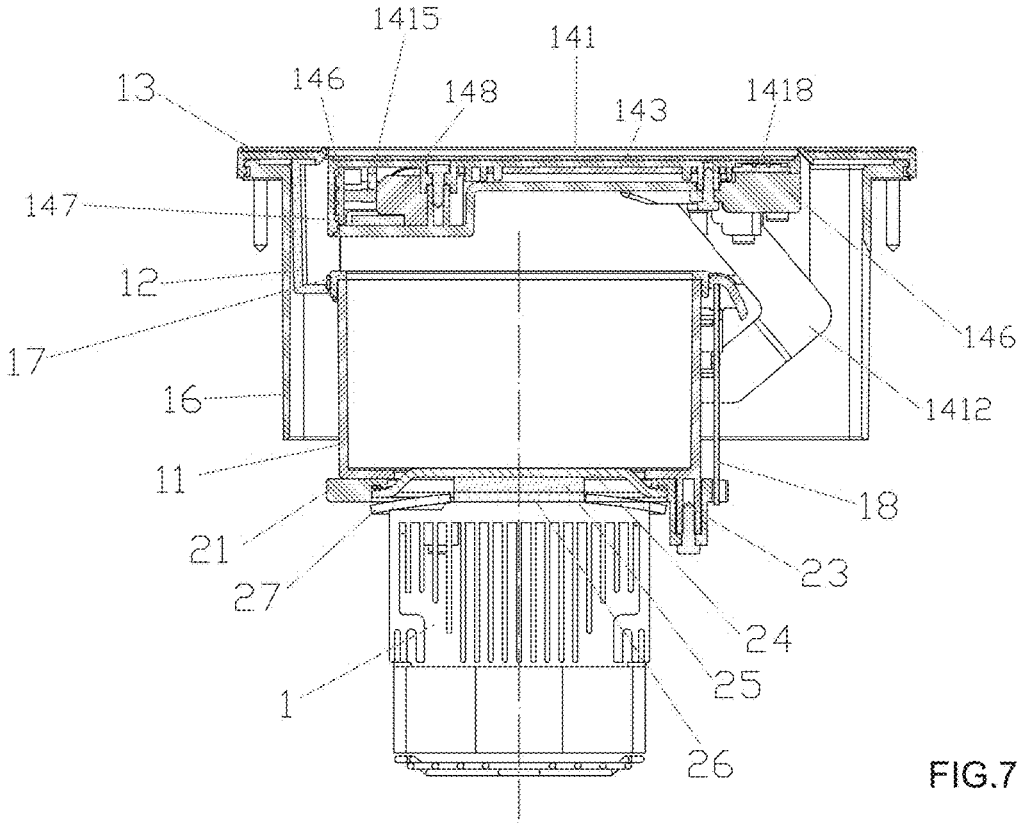
FIG. 7 is a schematic sectional view of A-A in FIG. 1.
Figure 8:
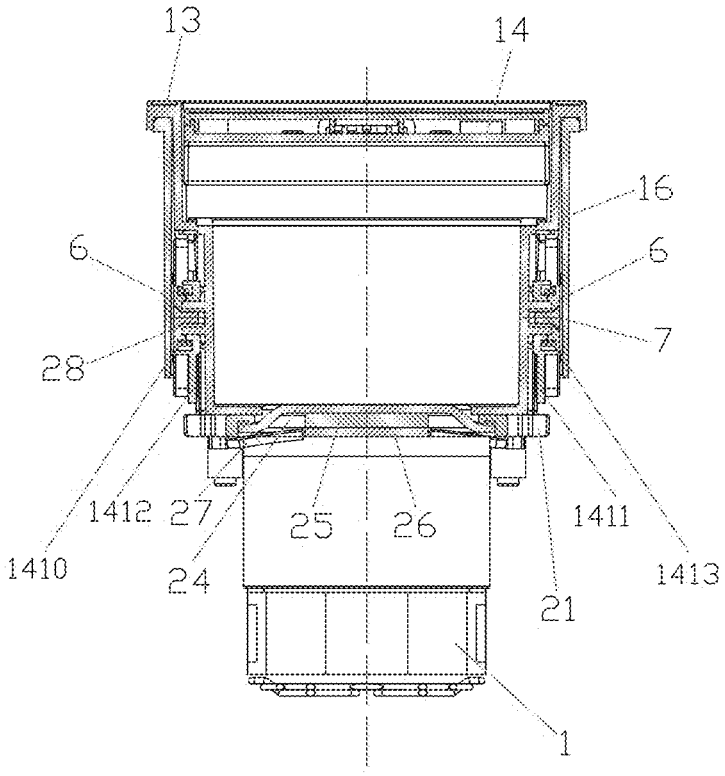
FIG. 8 is a schematic sectional view of B-B in FIG. 1.
Figure 9A:
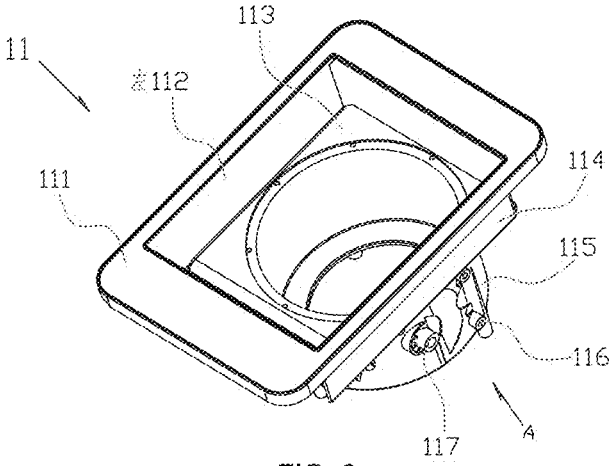
FIG. 9*a* is a first three-dimensional schematic view of a contour of the cup holder in FIG. 3.
Figure 9B:
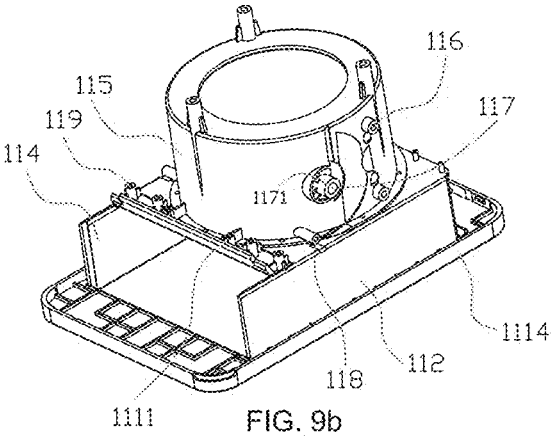
FIG. 9*b* is a second three-dimensional schematic view of a contour of components of the cup holder in FIG. 3.
Figure 9C:
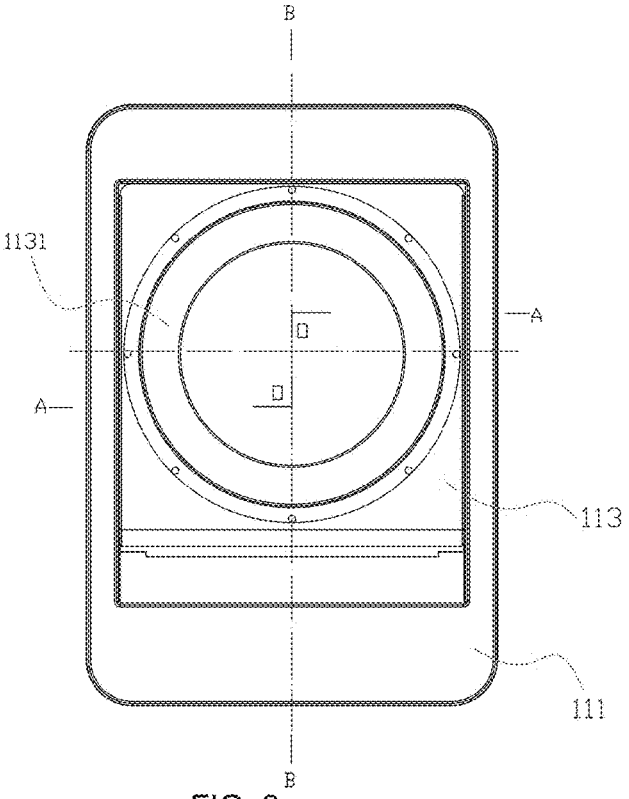
FIG. 9*c* is a schematic front view of the cup holder.
Figure 9D:
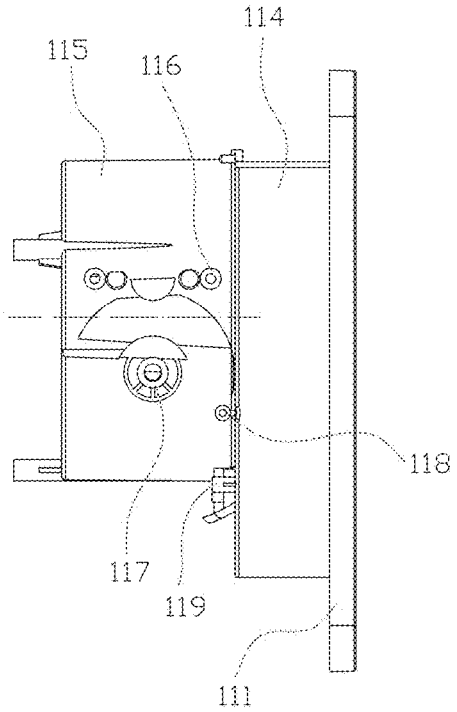
FIG. 9*d* is a schematic left view of FIG. 9*c*.
Figure 9E:
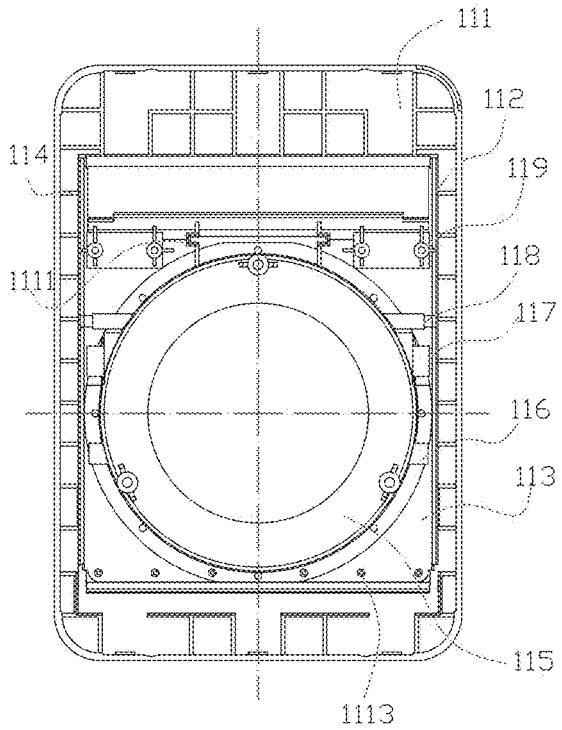
FIG. 9*e* is a schematic rear view of FIG. 9*c*.
Figure 9F:
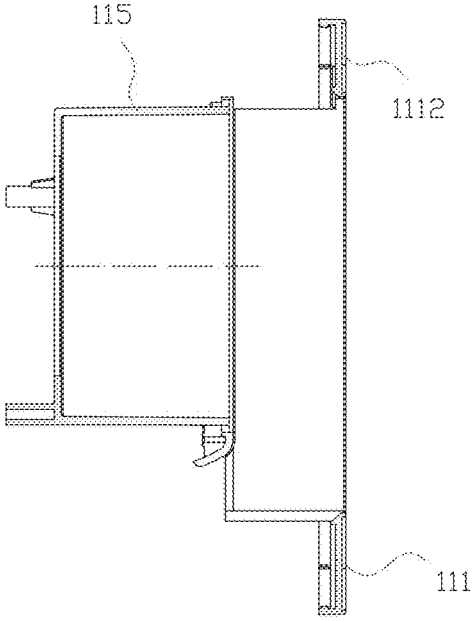
FIG. 9*f* is a schematic sectional view of B-B in FIG. 9*c*.
Figure 9G:
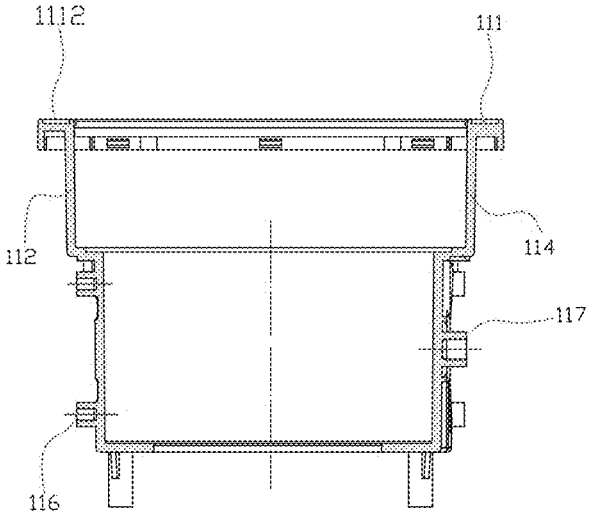
FIG. 9*g* is a schematic sectional view of an A00A step in FIG. 9*c;*
Figure 10B:
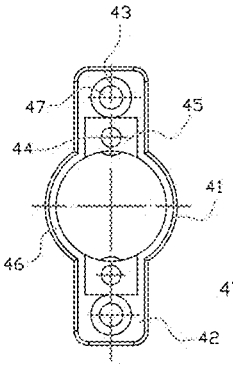
FIG. 10*b* is a schematic view of the C direction in FIG. 10*a;*
Figure 10A:
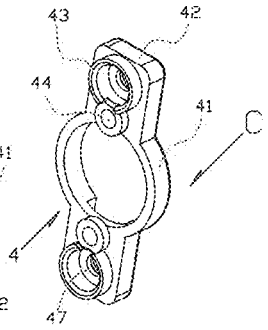
FIG. 10*a* is a three-dimensional schematic view of the damper bracket in FIG. 3.
Figure 11:
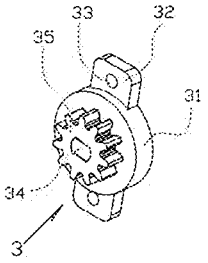
FIG. 11 is a three-dimensional schematic view of the damper in FIG. 3.
Figure 12A:
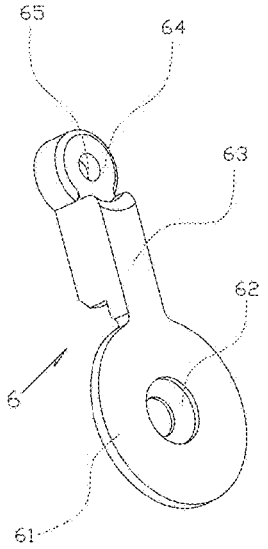
FIG. 12*a* is a three-dimensional schematic view of the spring pressing plate in FIG. 3.
Figure 12C:
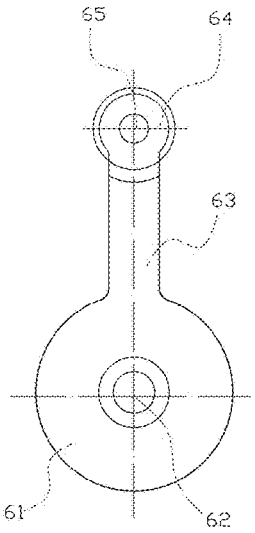
FIG. 12*c* is a schematic right view of FIG. 12*b*.
Figure 12B:
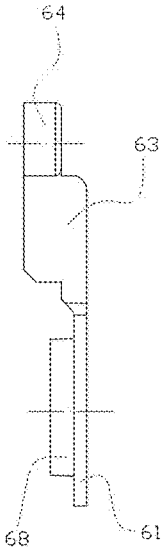
FIG. 12*b* is a schematic front view of FIG. 12*a*.
Figure 12D:
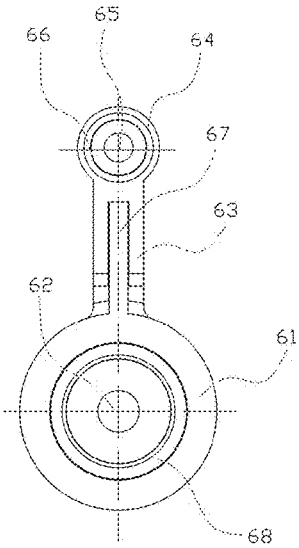
FIG. 12*d* is a schematic left view of FIG. 12*b;*
Figure 13D:
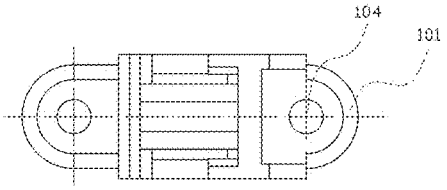
FIG. 13*d* is a schematic bottom view of FIG. 13*b;*
Figure 13B:
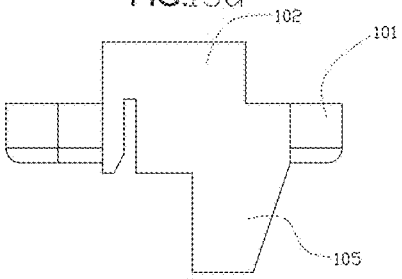
FIG. 13*b* is a schematic front view of FIG. 13*a*.
Figure 13C:
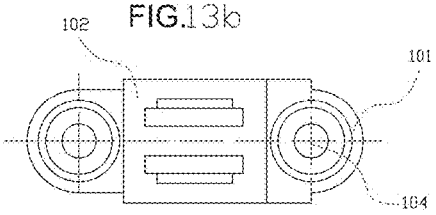
FIG. 13*c* is a schematic top view of FIG. 13*b*.
Figure 13A:
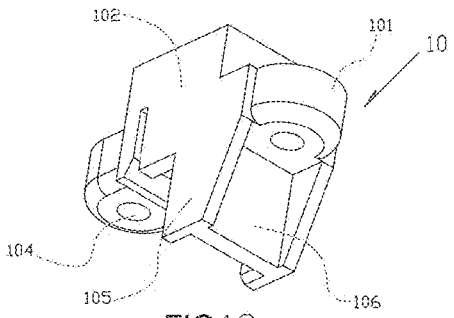
FIG. 13*a* is a three-dimensional schematic view of the self-locking switch bracket in FIG. 3.
Figure 14:
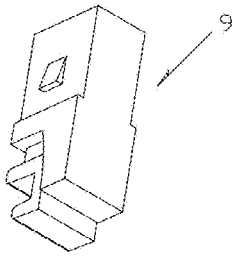
FIG. 14 is a three-dimensional schematic view of the self-locking switch in FIG. 3.

The thermoelectric cooler 26 in FIG. 4 and FIG. 7 is used to double as cooling or heating.

Figure 20A:
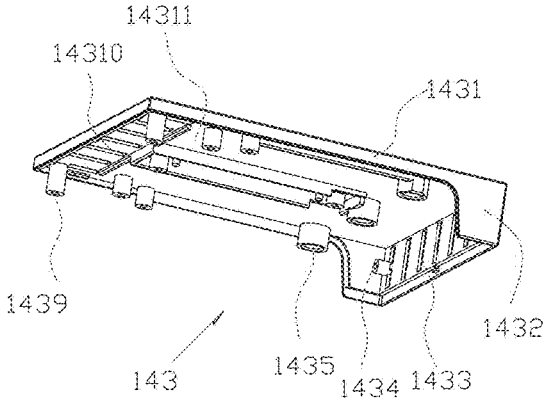
FIG. 20*a* is a three-dimensional schematic view of the rotary face shell in the rotary flip in FIG. 3.
Figure 20D:
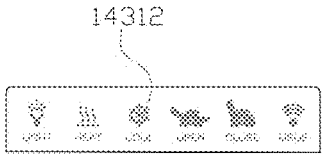
FIG. 20*d* is a schematic top view of FIG. 20*b;*
Figure 20B:
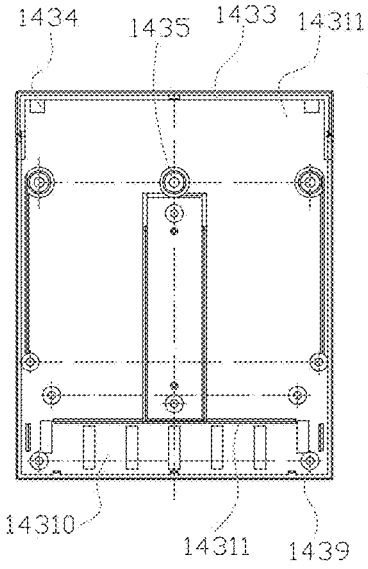
FIG. 20*b* is a schematic bottom view of FIG. 20*a*.
Figure 20C:
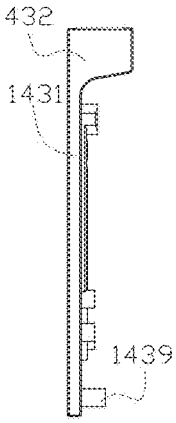
FIG. 20*c* is a schematic left view of FIG. 20*b*.
Figure 21B:
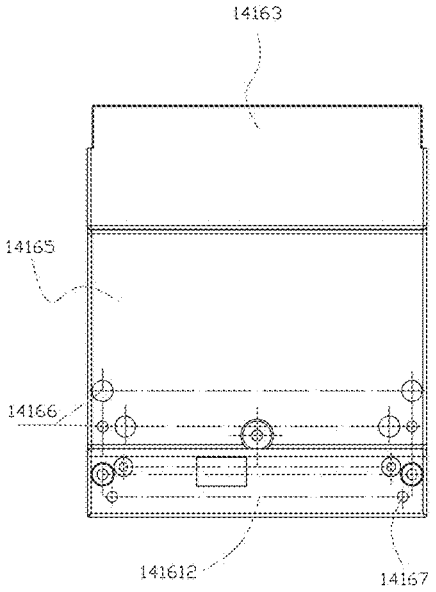
FIG. 21*b* is a schematic right view of FIG. 21*a*.
Figure 21A:
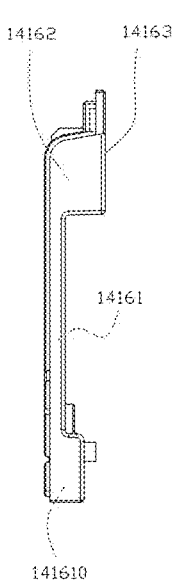
FIG. 21*a* is a schematic front view of the flip bottom shell in the rotary flip in FIG. 3.
Figure 21C:
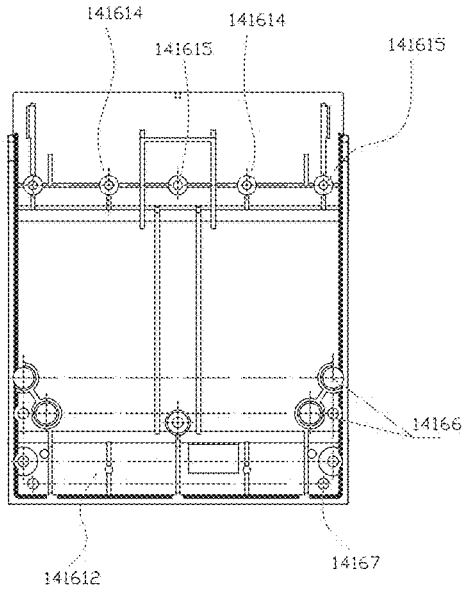
FIG. 21*c* is a schematic left view of FIG. 21*b*.
Figure 21D:
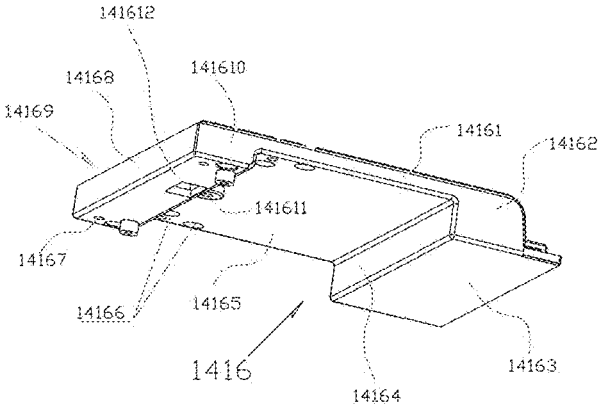
FIG. 21*d* is a three-dimensional schematic view of FIG. 21*b;*
Figure 22:
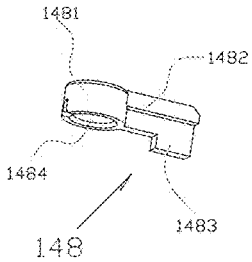
FIG. 22 is a three-dimensional schematic view of the backlight pressing block in FIG. 5.
Figure 23:
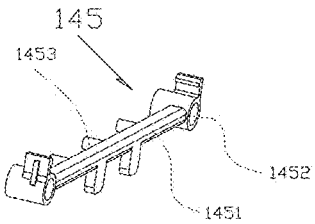
FIG. 23 is a three-dimensional schematic view of the touch circuit board A bracket in FIG. 5.
Figure 24:
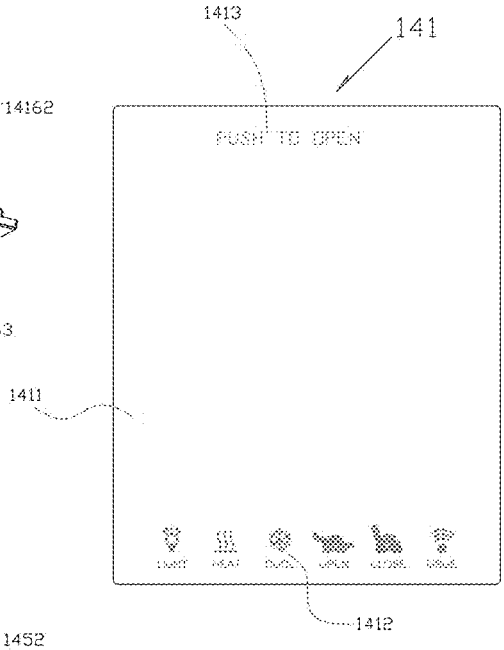
FIG. 24 is a schematic front view of the flip panel in FIG. 3.
Figures 25A, 25B, 25C, 25D:
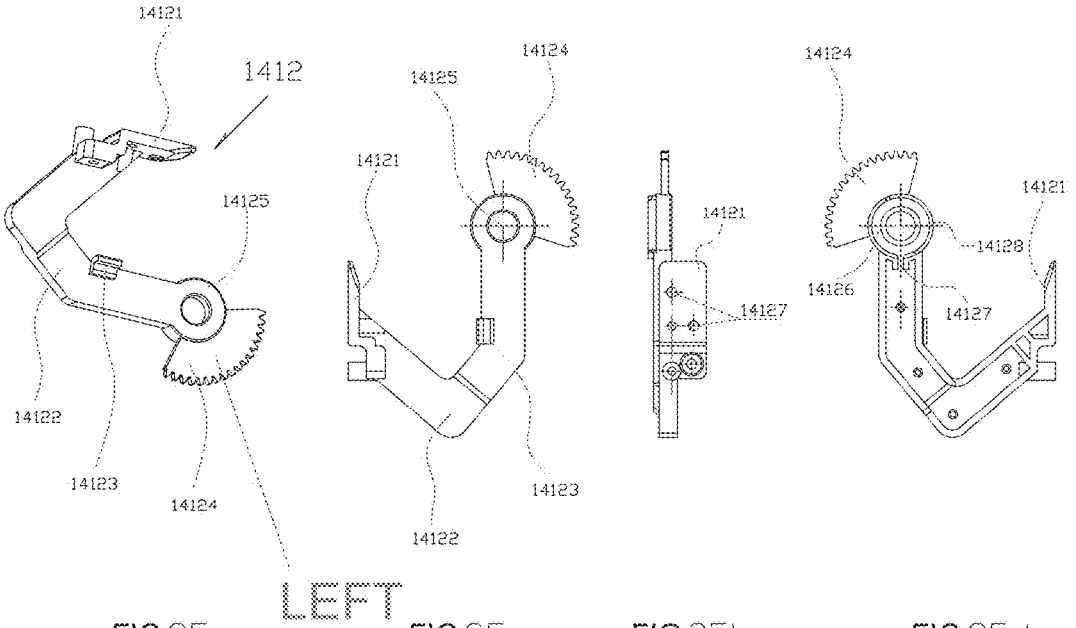
FIG. 25*a* is a three-dimensional schematic view of the left rotating arm in the rotary flip in FIG. 3.
FIG. 25*b* is a schematic front view of the left rotating arm.
FIG. 25*c* is a schematic right view of FIG. 25*b*.
FIG. 25*d* is a schematic left view of FIG. 25*b;*
Figure 26A:
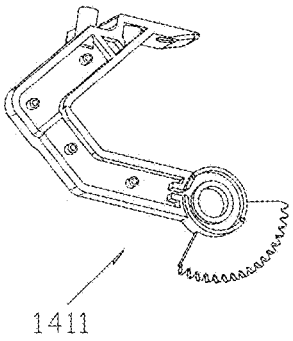
FIG. 26*a* is a three-dimensional schematic view of the right rotating arm in the rotary flip in FIG. 3.
Figure 26C:
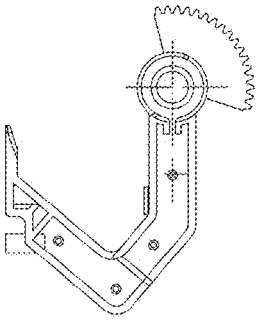
FIG. 26*c* is a schematic right view of FIG. 26*b*.
Figure 26B:
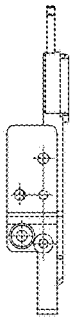
FIG. 26*b* is a schematic front view of the right rotating arm.
Figure 26D:
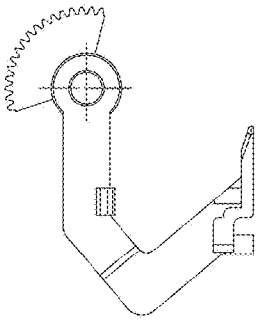
FIG. 26*d* is a schematic left view of FIG. 26*b;*
Figure 27:
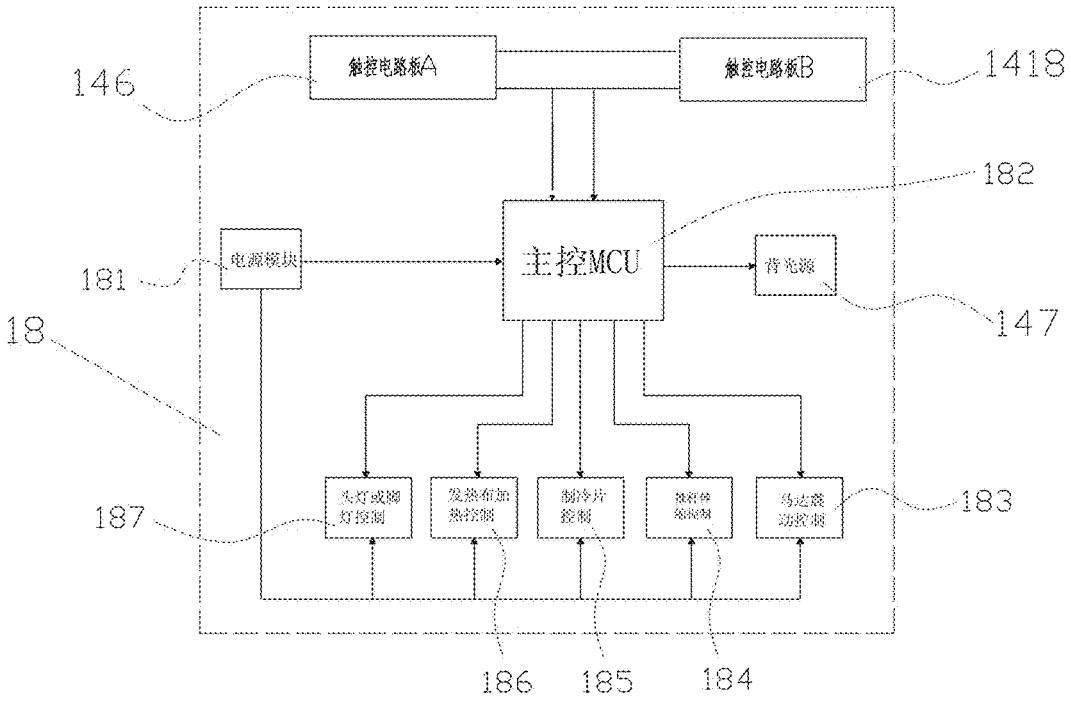
FIG. 27 is a block diagram of circuitry of the control circuit board in FIG. 3.

Embodiment 2 please refer to FIG. 27, FIG. 20*d* and FIG. 24. This embodiment has made the following improvements on the basis of the aforementioned technical solution:

the output end of the main control MCU 182 in the control circuit of the control circuit board 18 is further in signaling connections with various functional control modules in a total control circuit in a seat respectively, and the functional control modules include a motor vibration control module 183, a headlight or footlight control module 187, a heating control module 186 and a push rod expansion and contraction control module 184; and touch key icons with various functions which are in the same row as the cooling key icon and control a seat are disposed near the front edge of the flip panel 1411 in the flip face shell 143 and on the outer surface of the bent edge 1433 of the rear side edge of the flip face shell 143, the touch key icons including icons of motor vibration, the ON/OFF of headlight or footlight, heating and push rod expansion and contraction.

Various functions in the seat can be controlled by pressing the touch key icons at the front edge of the flip panel 1411 in the flip face shell and on the outer surface of the bent edge 1433 of the rear side edge thereof.

Further, a decorative ring 17 (refer to FIG. 4 and FIG. 7) is further disposed in the aforementioned two embodiments, wherein an outer surface of the decorative ring 17 is an electroplated glossy surface, which is assembled on the top surface of the circular socket 115 in the cup holder 11.

Furthermore, a rectangular socket 16 (refer to FIG. 4 and FIG. 19*a* to FIG. 19*c*) is further disposed, wherein the rectangular socket 16 includes a small rectangular ring plate 161 that can be nested in the bent edge 1114, which extends downwardly, of the rectangular ring plate 111 in the frame of the cup holder 11, and bottom surfaces of four corners of the small rectangular ring plate 161 each are provided thereon with a female threaded hole 165; a rectangular cover that extends downwardly is further fixedly connected inside the four female threaded holes 165, the rectangular cover includes a left side plate 162, a right side plate 164, a rear side plate 163 which are as high as each other and a shorter front side slat 166 and can be just sheathed outside the left side plate 112, the right side plate 114 and the rear side frame 12 in the frame of the cup holder 11 where the rear side frame 12 has been assembled, and an appropriate large notch is disposed below a front panel of the rectangular cover. The four screw holes 165 in the rectangular socket 16 are prepared for installing the cooling cup holder to the seat, and as shown in FIG. 4, four screws can be used to pass through the four screw holes 165 respectively, to install the cooling cup holder into the seat.

Further, a frame panel 13 (refer to FIG. 4) is further disposed, wherein the frame panel 13 is a rectangular annular plastic sheet, and is stuck to the upper surface of the rectangular ring plate 111 in the frame of the cup holder 11, used for increasing the sense of beauty of the product.

Further, an "O"-shaped seal ring 23 (refer to FIG. 4 and FIG. 8) is further disposed, wherein the "O"-shaped seal ring 23 is assembled between an upper surface of the plate edge 241 of the thermal conductive plate 24 and a lower surface of the annular shallow slot 218 of the inner bore 217 of the bottom cap 21, used for preventing the beverage in the beverage cup to leak downwardly.

Further, outer side faces of the "C"-shaped bending arms in the left rotating arm 1412 and the right rotating arm 1411 each are provided thereon with a reinforcing plate 1414.

The middle of the bottom surface of the rectangular top plate II 14311 in the rotary face shell 143 is further provided with an elongated reinforcing plate 1436.

In other exemplary embodiments the disclosed device includes a wireless charging station 2000 as shown in FIGS. 28-34, for recharging, e.g., a rechargeable battery of a mobile electronic device. Wireless charging station 2000 can incorporate any suitable wireless charger as known in the art, for example and without limitation, an electromagnetic induction wireless charger according to the Qi wireless charging standard. In other embodiments wireless charging station 2000 may be a wireless charger such as according to the Power Matters Alliance (PMA) standard, Alliance for Wireless Power (A4WP) standard, iNPOFi technology, or any other wireless charger within the spirit and scope of this disclosure. The wireless charging station 2000 may also operate using, e.g., radio waves and/or magnetic resonance.

Figure 28:
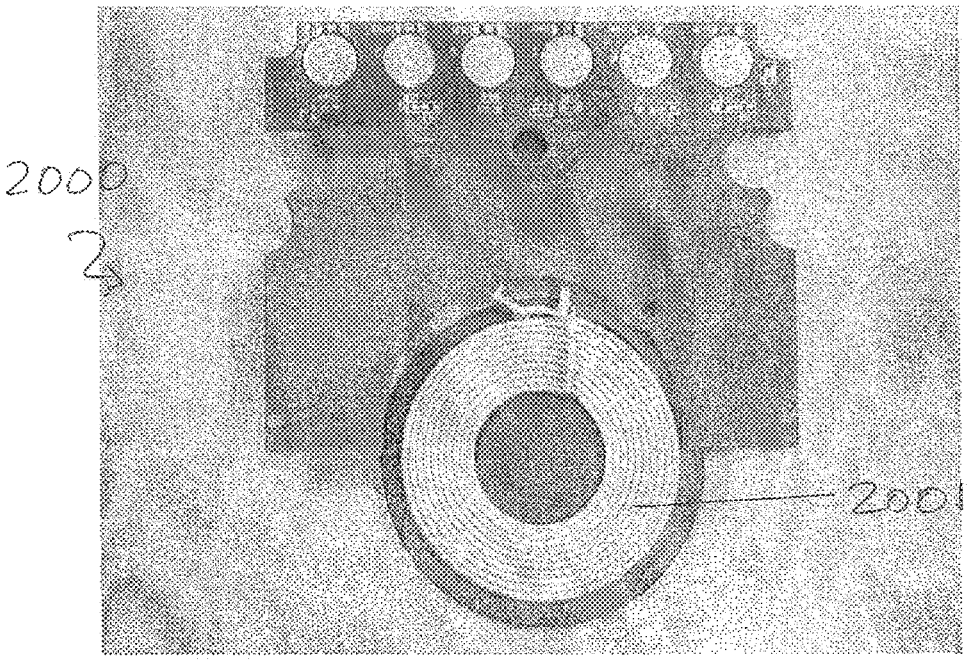
FIG. 28 shows a first view of an exemplary wireless charging station for use with the disclosed device.
Figure 29:
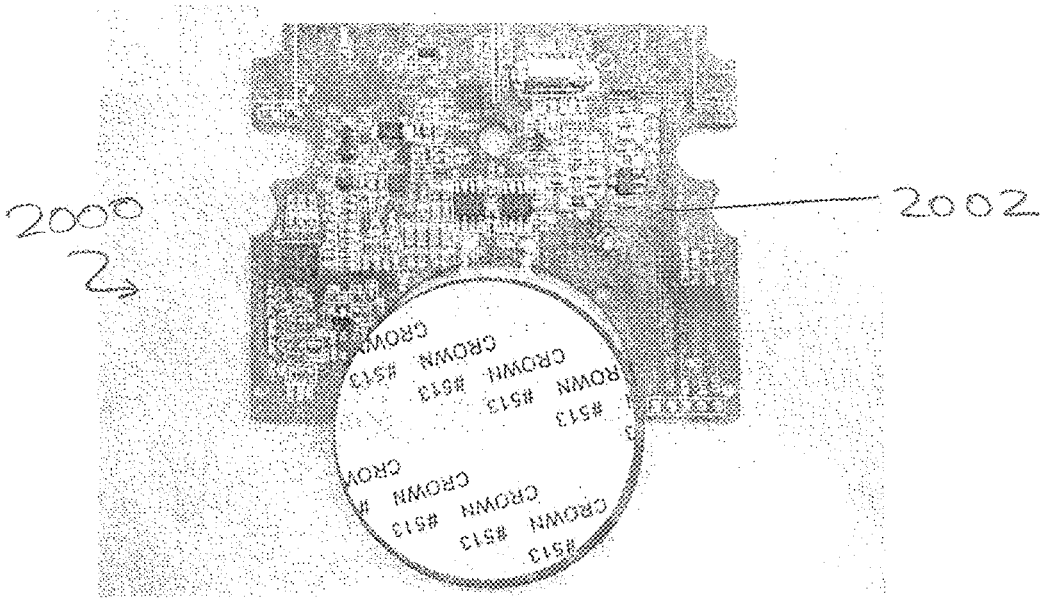
FIG. 29 shows a second view of an exemplary wireless charging station for use with the disclosed device.

The exemplary embodiment shown by FIGS. 28-34 includes a Qi wireless charging station 2000 which structure is incorporated into any or all of rotary flip 14, flip panel 141, rotary face shell 143, and/or flip bottom shell 1416. FIGS. 28-29 show an exemplary Qi wireless charging station. Wireless charging station includes, among other things, induction coil 2001, and transmitting module 2002.

Figure 30:
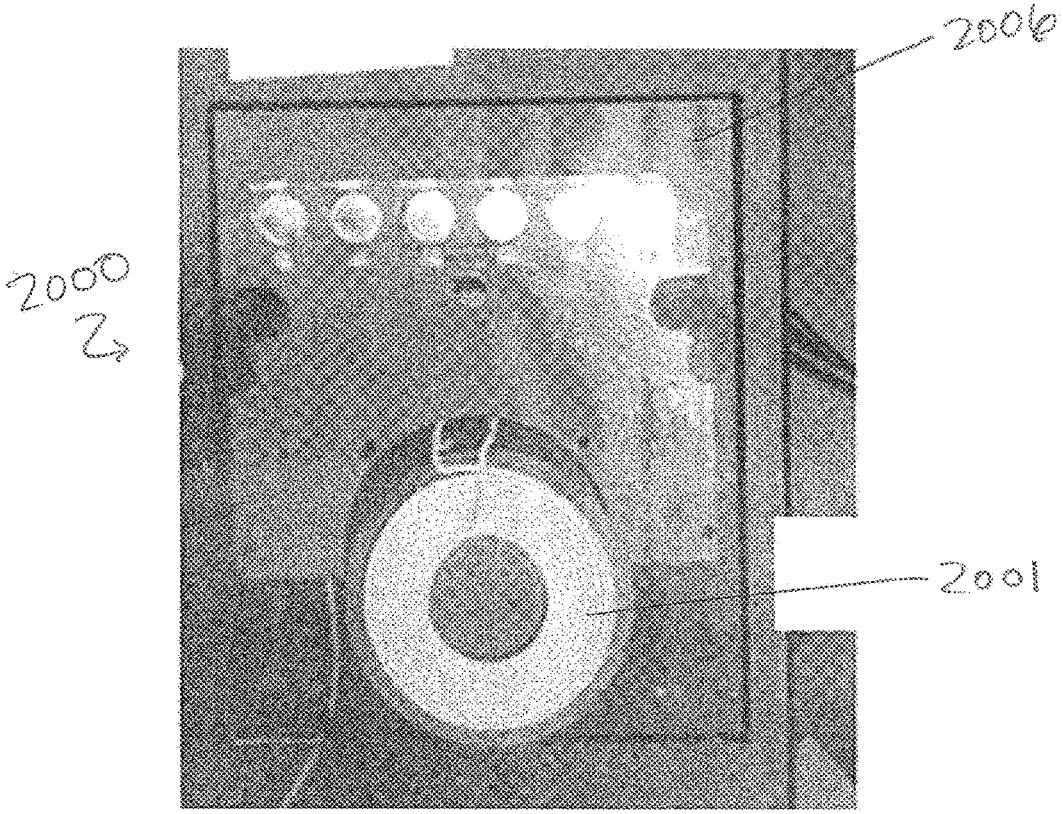
FIG. 30 shows an exemplary wireless charging station on the disclosed device.

FIG. 30 shows the wireless charging station 2000 incorporated onto a bottom surface 2006 of the flip panel 141, as in an exemplary embodiment.

In the exemplary embodiment, power module 181 provides power to the wireless charging station 2000 by way of the transmitting module 2002. Transmitting module 2002 may use a known component or components, such as an inverter (not shown), to convert a direct current to an alternating current. Induction coil 2001 generates pulses of electromotive force which may be received by certain electronic devices 2005 having a receiving coil (not shown) for wireless charging. Principles of induction and electromotive applications are generally known including for wireless charging products.

In the exemplary embodiment of FIGS. 28-34, induction coil 2001 is located in sufficient proximity to flip panel 141 and an electronic device 2005 with wireless charging capability such that electromotive transmissions from the induction coil 2001 are received by the electronic device 2005 for recharging at least one power source of the electronic device. Electronic device 2005 may be placed, for example and without limitation, on a top surface 2007 of the flip panel 141.

Figure 31:
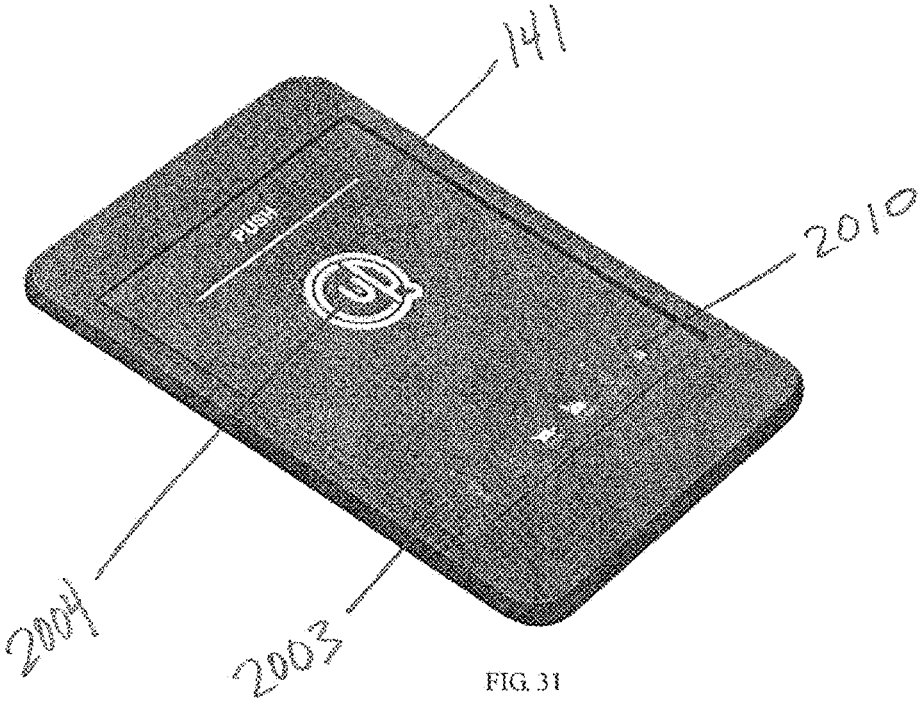
FIG. 31 shows an exemplary wireless charging area of the disclosed device.
Figure 32:
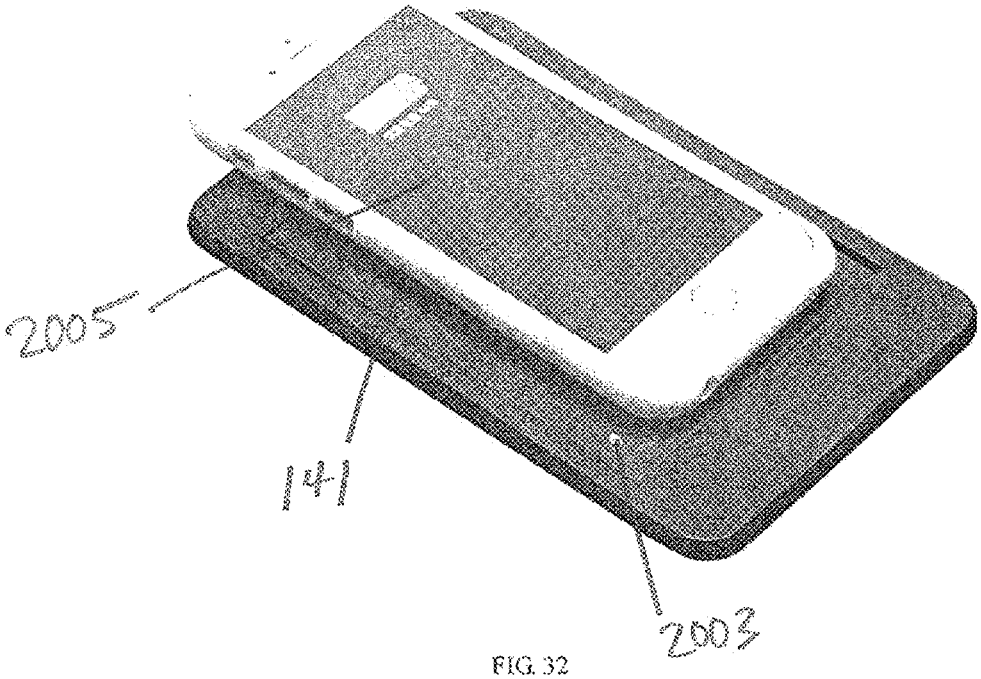
FIG. 32 shows a mobile electronic device on an exemplary wireless charging area of the disclosed device.

As shown in the exemplary embodiment of FIGS. 31-32, wireless charging area 2004 is identified by the Qi wireless charging logo. In other embodiments the wireless charging area 2004 may be located in any suitable position consistent with this disclosure. As further shown in the exemplary embodiment of FIGS. 31-32, touch key array 2010 is provided on the flip panel 141.

In addition to the touch key array 2010 and functions previously described, wireless charging indicator light 2003 may be provided on the touch key array 2010. Wireless charging indicator light 2003 may illuminate or change colors when wireless charging is initiated between the wireless charging station 2000 and an electronic device 2005. In one embodiment, wireless charging may automatically initiate when a compatible electronic device 2005 is placed on wireless charging area 2004. In other embodiments, a manual control (not shown) may be used to initiate wireless charging or turn the feature on and off.

Figure 33:
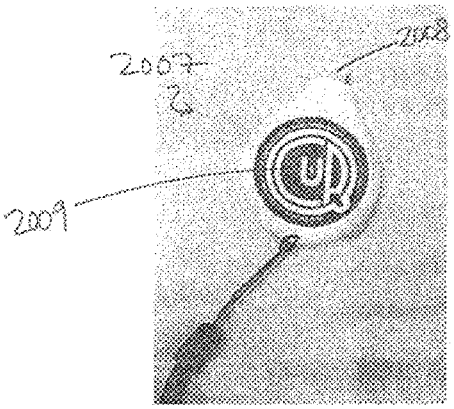
FIG. 33 shows an exemplary wireless modular power receiver for use with the disclosed device; and, FIG. 34 shows an exemplary wireless modular power receiver on a mobile electronic device for use with the disclosed device.
Figure 34:
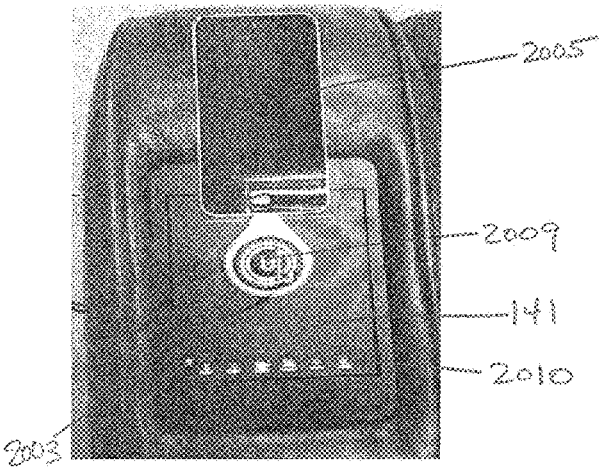

A modular wireless power receiver 2007, shown in FIGS. 33-34, may also be included in an exemplary embodiment of the disclosed device. Modular wireless power receiver 2007 provides wireless charging capability to an electronic device that does not have an integral receiving module for wireless charging. Modular wireless power receiver 2007 includes, among other things, a receiving module for, e.g., receiving, rectifying, and filtering wireless energy transmissions, and a charging port connector 2008 for directing the current to the rechargeable device power source.

As used herein a "wireless device" may be, for example, a smartphone, tablet computer, smart watch, PDA, or other mobile or non-mobile electronic device with a rechargeable power source.

The above are merely preferred embodiments of the present utility model, but do not limit the implementation scope of the present utility model. Therefore, equivalent variation and modification without departing from the claims of the present utility model should still fall within the protection scope of the present utility model.

The invention claimed is:

1. A multi-functional cup holder, comprising:

an annular socket having an inner surface, an outer surface, and an interior space extending between an open top end and an open bottom end of the annular socket; and, a rotary flip comprising:

a rectangular top plate having a top surface, a bottom surface, a proximal end, and a distal end having a surface that extends in a direction that is substantially perpendicular to the top surface;

a top touch panel overlying the top surface of the rectangular top plate and having at least one touch-activated button for controlling a function of the cup holder or another device;

a distal touch panel overlying the distal end surface of the rectangular top plate and having at least one touch-activated button for controlling a function of the cup holder or another device;

a left rotating arm attached at a first end to a left side of the bottom surface of the rectangular top plate and at a second end to the outer surface of the annular socket; and, a right rotating arm attached at a first end to a right side of the bottom surface of the rectangular top plate and at a second end to the outer surface of the annular socket;

wherein:

the left and right rotating arms each include a releasable locking mechanism having at least a first releasably locked position and a second releasably locked position such that:

in the first releasably locked position of the left and right rotating arms the rectangular top plate of the rotary flip overlies the open top end of the annular socket and the bottom surface of the rectangular top plate is between the top touch panel and the open top end of the annular socket; and, in the second releasably locked position of the left and right rotating arms the rectangular top plate of the rotary flip is substantially parallel to the outer surface of the annular socket in the direction extending between the open top end and the open bottom end, and the distal touch panel is nearest the open top end.

2. The multi-functional cup holder of claim 1, further comprising a wireless charging station.

3. The multi-functional cup holder of claim 2, wherein the wireless charging station is below a bottom surface of the top touch panel between the top touch panel and the top surface of the rectangular top plate.

4. The multi-functional cup holder of claim 2, wherein the top touch panel includes a wireless charging indicator light.

5. The multi-functional cup holder of claim 2, wherein the wireless charging station is a Qi wireless charging station.

6. The multi-functional cup holder of claim 5, wherein the wireless charging station comprises an induction coil and a transmitting module.

7. The multi-functional cup holder of claim 2, further comprising:

a thermal conductive plate at the open bottom end of the annular socket;

at least one thermoelectric cooler under the thermal conductive plate; and, a thermal radiator under the thermal conductive plate, wherein the thermal conductive plate includes at least one surface that is exposed to the interior space of the annular socket, and the thermoelectric cooler includes at least one surface that faces toward the thermal conductive plate.

8. The multi-functional cup holder of claim 7, wherein at least one touch-activated button on the top touch panel or the distal touch panel is electrically connected to at least one of the thermoelectric cooler or thermal radiator.

9. The multi-functional cup holder of claim 1, wherein the multi-functional cup holder is installed in an article of furniture, and at least one touch-activated button on the top touch panel or the distal touch panel is electrically connected to at least one of a reclining mechanism, a massaging mechanism, and an electrical device in the article of furniture.

10. The multi-functional cup holder of claim 1, wherein the left and right rotating arms each include a toothed portion having notched teeth and the releasable locking mechanism of each of the left and right rotating arms comprises at least one torsion spring forcing the notched teeth into locking slots.

11. A multi-functional cup holder, comprising:

an annular socket having an inner surface, an outer surface, and an interior space extending between an open top end and an open bottom end of the annular socket; and, a rotary flip comprising:

a rectangular top plate having a top surface, a bottom surface, a proximal end, and a distal end having a surface that extends in a direction that is substantially perpendicular to the top surface;

a top touch panel overlying the top surface of the rectangular top plate and having at least one touch-activated button for controlling a function of the cup holder or another device;

a wireless charging station for an electronic device;

a distal touch panel overlying the distal end surface of the rectangular top plate and having at least one touch-activated button for controlling a function of the cup holder or another device;

a left rotating arm attached at a first end to a left side of the bottom surface of the rectangular top plate and at a second end to the outer surface of the annular socket; and, a right rotating arm attached at a first end to a right side of the bottom surface of the rectangular top plate and at a second end to the outer surface of the annular socket;

wherein:

the left and right rotating arms include a releasable locking mechanism having at least a first releasably locked position and a second releasably locked position such that:

in the first releasably locked position of the left and right rotating arms the rectangular top plate of the rotary flip overlies the open top end of the annular socket and the bottom surface of the rectangular top plate is between the top touch panel and the open top end of the annular socket; and, in the second releasably locked position of the left and right rotating arms the rectangular top plate of the rotary flip is substantially parallel to the outer surface of the annular socket in the direction extending between the open top end and the open bottom end, and the distal touch panel is nearest the open top end.

12. The multi-functional cup holder of claim 11, wherein the top touch panel includes a wireless charging indicator light.

13. The multi-functional cup holder of claim 11, wherein the wireless charging station is a Qi wireless charging station.

14. The multi-functional cup holder of claim 13, wherein the wireless charging station comprises an induction coil and a transmitting module.

15. The multi-functional cup holder of claim 11, further comprising:

a thermal conductive plate at the open bottom end of the annular socket;

at least one thermoelectric cooler under the thermal conductive plate; and, a thermal radiator under the thermal conductive plate, wherein the thermal conductive plate includes at least one surface that is exposed to the interior space of the annular socket, and the thermoelectric cooler includes at least one surface that faces toward the thermal conductive plate.

16. The multi-functional cup holder of claim 15, wherein at least one touch-activated button on the top touch panel or the distal touch panel is electrically connected to at least one of the thermoelectric cooler or thermal radiator.

17. The multi-functional cup holder of claim 11, wherein the multi-functional cup holder is installed in an article of furniture, and at least one touch-activated button on the top touch panel or the distal touch panel is electrically connected to at least one of a reclining mechanism, a massaging mechanism, and an electrical device in the article of furniture.

18. The multi-functional cup holder of claim 11, wherein the left and right rotating arms each include a toothed portion having notched teeth and the releasable locking mechanism of each of the left and right rotating arms comprises at least one torsion spring forcing the notched teeth into locking slots.

19. A multi-functional cup holder, comprising:

an annular socket extending between an open top end and an open bottom end and having an inner surface and an outer surface; and, a rotary flip comprising:

a rectangular top plate;

a top touch panel overlying a top surface of the rectangular top plate and having at least one touch-activated button for controlling a function of the cup holder or another device;

a wireless charging station;

a left rotating arm attached at a first end to a left side of a bottom surface of the rectangular top plate and at a second end to the outer surface of the annular socket; and, a right rotating arm attached at a first end to a right side of the bottom surface of the rectangular top plate and at a second end to the outer surface of the annular socket.

20. The multi-functional cup holder of claim 19, wherein the rectangular top plate further comprises a distal end having a surface that extends in a direction that is substantially perpendicular to the top surface.

* * * * *